US010697334B2

(12) United States Patent
Kinouchi et al.

(10) Patent No.: US 10,697,334 B2
(45) Date of Patent: Jun. 30, 2020

(54) VALVE TIMING ADJUSTING DEVICE

(71) Applicant: DENSO CORPORATION, Kariya, Aichi-pref. (JP)

(72) Inventors: Soichi Kinouchi, Kariya (JP); Akira Iwasaki, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/524,634

(22) Filed: Jul. 29, 2019

(65) Prior Publication Data

US 2020/0040778 A1 Feb. 6, 2020

(30) Foreign Application Priority Data

Jul. 31, 2018 (JP) ..... 2018-143243

(51) Int. Cl.
*F01L 1/352* (2006.01)

(52) U.S. Cl.
CPC ..... *F01L 1/352* (2013.01)

(58) Field of Classification Search
CPC ... F01L 1/344; F01L 1/352; F01L 1/46; F01L 2101/00; F01L 2800/16; F01L 2810/04
USPC ..... 123/90.15, 90.17
See application file for complete search history.

(56) References Cited

U.S. PATENT DOCUMENTS

| | | | | |
|---|---|---|---|---|
| 9,856,761 | B2 | 1/2018 | Iwasaki | |
| 2007/0163526 | A1 | 7/2007 | Sugiura et al. | |
| 2009/0038570 | A1 | 2/2009 | Schafer et al. | |
| 2009/0301416 | A1 | 12/2009 | Watanabe | |
| 2011/0265747 | A1 | 11/2011 | Tadokoro et al. | |
| 2014/0014052 | A1 | 1/2014 | Tadokoro et al. | |
| 2016/0298506 | A1* | 10/2016 | Iwasaki | F01L 1/022 |
| 2017/0138228 | A1 | 5/2017 | Miyachi et al. | |

FOREIGN PATENT DOCUMENTS

| | | |
|---|---|---|
| JP | 2018-087564 | 6/2018 |
| JP | 2018-123727 | 8/2018 |
| JP | 2019-044800 | 3/2019 |

* cited by examiner

*Primary Examiner* — Jorge L Leon, Jr.
(74) *Attorney, Agent, or Firm* — Nixon & Vanderhye P.C.

(57) ABSTRACT

A driving rotor is configured to rotate about a rotational shaft center in conjunction with a crankshaft. A driven rotor is configured to rotate about the rotational shaft center in conjunction with the camshaft. A deceleration mechanism is configured to change a relative rotational phase between the driving rotor and the driven rotor by using a driving force of an electric motor. The deceleration mechanism includes an internal gear portion, which includes an internal tooth extending radially inward, and an external gear portion, which includes an external tooth extending radially outward and engaging with the internal tooth. A linear expansion coefficient of the external gear portion is greater than a linear expansion coefficient of the internal gear portion.

13 Claims, 27 Drawing Sheets

VALVE TIMING ADJUSTING DEVICE

CROSS REFERENCE TO RELATED APPLICATION

The present application claims the benefit of priority from Japanese Patent Application No. 2018-143243 filed on Jul. 31, 2018. The entire disclosure of the above application is incorporated herein by reference.

TECHNICAL FIELD

The present disclosure relates to a valve timing adjusting device.

BACKGROUND

Conventionally, a valve timing adjusting device is provided to an internal combustion engine. In one example, a valve timing adjusting device is coupled to a crankshaft of an internal combustion engine via a chain and is further connected to one end of a camshaft. The valve timing adjusting device is configured to vary a relative rotational phase between the crankshaft and the camshaft thereby to enable to vary timings of opening and closing of an intake valve and/or an exhaust valve of the internal combustion engine.

SUMMARY

According to one aspect of the present disclosure, a valve timing adjusting device is configured to adjust a valve timing of a valve. The valve timing adjusting device includes a driving rotor, a driven rotor, and a deceleration mechanism configured to vary a relative rotational phase between the driving rotor and the driven rotor.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1:
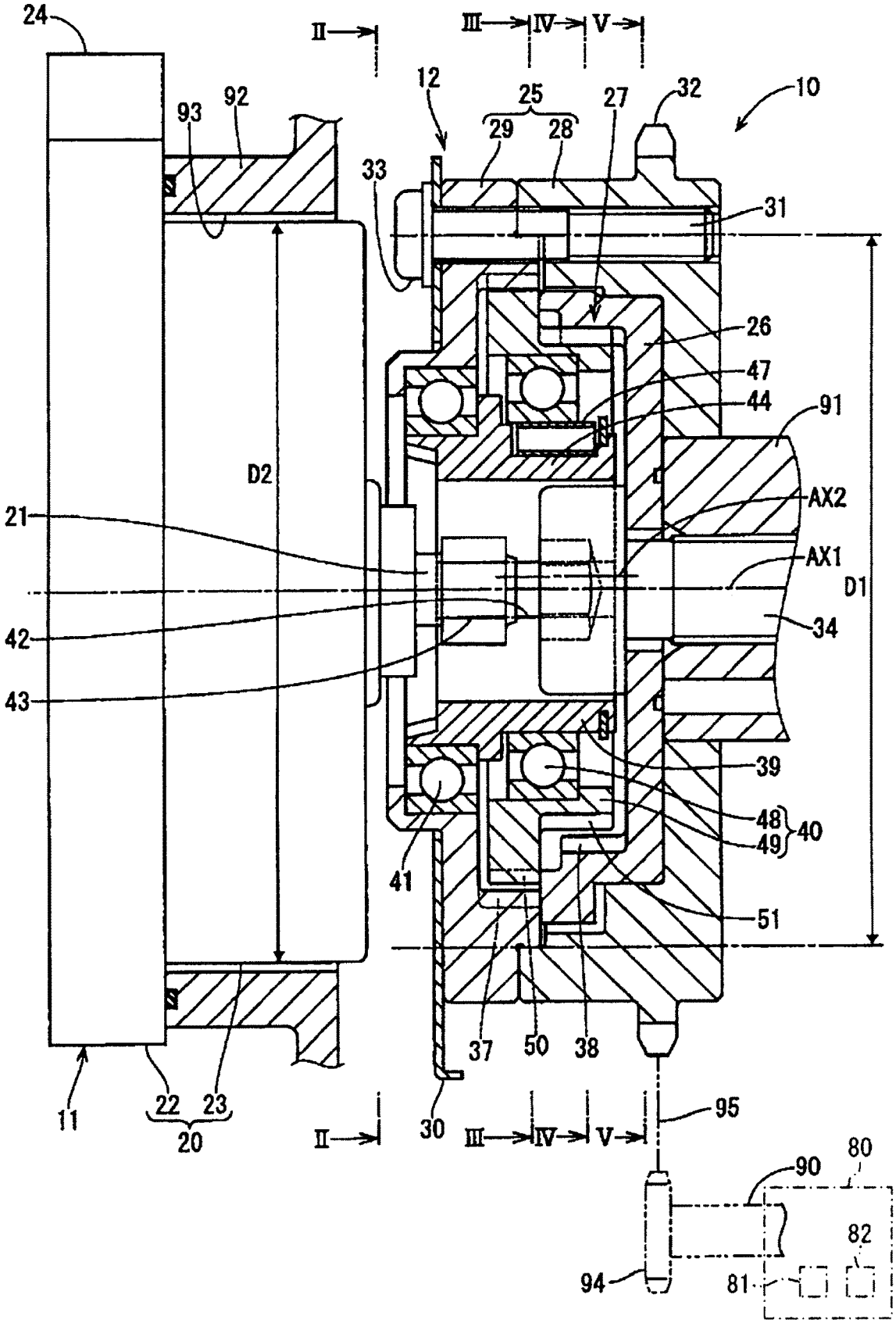
FIG. 1 is a cross-sectional view illustrating a schematic configuration of a valve timing adjusting device.

To begin with, examples of the present disclosure will be described.

According to one example of the present disclosure, a valve timing adjusting device includes a driving rotor, a driven rotor, and a deceleration mechanism. The driving rotor rotates in conjunction with a crankshaft of an internal combustion engine. The driven rotor rotates in conjunction with a camshaft of the engine. The deceleration mechanism varies relative rotational phases between the driving rotor and the driven rotor. The camshaft drives a valve to open and close the valve. The valve timing adjusting device adjusts the valve timing of the valve. According to one example, the deceleration mechanism is variously configured to include a planetary rotor having a planetary gear portion or to include a retainer to retain a plurality of rollers. In one example, a valve timing adjusting device may include the deceleration mechanism including a retainer.

When the valve timing adjusting device is driven, the deceleration mechanism could collide with a driving-rotor member or a driven-rotor member, or components of the deceleration mechanism could collide with each other. Consequently, a rattling sound may occur. The rattling sound may be reduced by fine-tuning sizes of a large number of components one by one used for the deceleration mechanism. However, the fine-tuning may increase work burden on the manufacture of the valve timing adjusting device. The deceleration mechanism may be newly or additionally equipped with special components to reduce a rattling sound. However, the additional special components may increase the number of parts of the valve timing adjusting device. In addition, the valve timing adjusting device may disadvantageously become larger in size. There has been room for improvement in inhibition of a rattling sound generated when driving the valve timing adjusting device.

According to one aspect of the present disclosure, a valve timing adjusting device is configured to adjust valve timing of a valve, which is configured to be opened and closed by a camshaft on application of engine torque transmitted from a crankshaft in an internal combustion engine. The valve timing adjusting device comprises a driving rotor rotational about a rotational shaft center in conjunction with the crankshaft. The valve timing adjusting device further comprises a driven rotor rotational about the rotational shaft center in conjunction with the camshaft. The valve timing adjusting device further comprises a deceleration mechanism configured to change a relative rotational phase between the driving rotor and the driven rotor by using a driving force of an electric motor. The deceleration mechanism includes at least one pair of gear portions. The at least one pair of gear portions includes an internal gear portion having an internal tooth formed inward in a radial direction. The at least one pair of gear portions further includes an external gear portion having an external tooth that is formed outward in a radial direction and engages with the internal tooth. A linear expansion coefficient of the external gear portion is larger than a linear expansion coefficient of the internal gear portion.

According to the valve timing adjusting device in this aspect, the linear expansion coefficient for the external gear portion is larger than the linear expansion coefficient for the internal gear portion. Therefore, the configuration may enable to decrease a difference between a pitch circle inner diameter of the internal gear portion and a pitch circle outer diameter of the external gear portion with an increase in temperature. The configuration may enable to decrease a distance, which is to enable the external gear portion and the internal gear portion to relatively move to each other. The configuration may enable to inhibit the momentum when a collision occurs between the external gear portion and the internal gear portion in a condition where the temperature rises. Therefore, the configuration may enable to inhibit the occurrence of a rattling sound when the valve timing adjusting device is driven.

According to another aspect of the present disclosure, a valve timing adjusting device is configured to adjust valve timing of a valve, which is configured to be opened and closed by a camshaft on application of engine torque transmitted from a crankshaft in an internal combustion engine. The valve timing adjusting device comprises a driving rotor rotational about a rotational shaft center in conjunction with the crankshaft. The valve timing adjusting device further comprises a driven rotor rotational about the rotational shaft center in conjunction with the camshaft. The valve timing adjusting device further comprises a deceleration mechanism configured to change a relative rotational phase between the driving rotor and the driven rotor by using a driving force of an electric motor. The deceleration mechanism includes at least one pair of roller mechanisms. The at least one pair of roller mechanisms includes a circular member having an internal tooth formed inward in a radial direction. The at least one pair of roller mechanisms further includes an inner rotor placed inside the circular member in a radial direction. The at least one pair of roller mechanisms further includes a plurality of rollers placed between the circular member and the inner rotor. The at least one pair of roller mechanisms further includes a retainer configured to retain the rollers between the circular member and the inner rotor. A linear expansion coefficient for the inner rotor is larger than a linear expansion coefficient for the circular member.

According to the valve timing adjusting device in this aspect, a linear expansion coefficient for the inner rotor is larger than a linear expansion coefficient for the circular member. Therefore, the configuration may enable to decrease a difference between a pitch circle inner diameter of the circular member and an outside diameter of the inner rotor with an increase in temperature. The configuration may enable to decrease a distance, which is between the inner rotor and the circular member and is to enable the roller to relatively move in the radial direction of the inner rotor in a condition where the temperature rises. The configuration may enable to inhibit the momentum when a collision occurs between the roller and the inner rotor and when a collision occurs between the roller and the circular member. Therefore, the configuration may enable to inhibit the occurrence of a rattling sound when the valve timing adjusting device is driven.

The present disclosure can be embodied in various modes. For example, the present disclosure can be embodied in modes such as a method of manufacturing the valve timing adjusting device, an internal combustion engine including the valve timing adjusting device, and a vehicle including such an internal combustion engine.

As follows, embodiments of the present disclosure will be described.

A. First Embodiment

FIG. 1 illustrates a valve timing adjusting device 10 according to a first embodiment. The valve timing adjusting device 10 varies a rotational phase of a camshaft 91 with reference to a crankshaft 90 of an internal combustion engine 80 of a vehicle and thereby to adjust the valve timing of an intake valve 81. The camshaft 91 opens and closes the intake valve 81 and an exhaust valve 82. The valve timing adjusting device 10 is provided for a path that transmits the power from the crankshaft 90 to the camshaft 91. The crankshaft 90 is equivalent to a driving shaft. The camshaft 91 is equivalent to a driven shaft. The intake valve 81 is equivalent to a valve.

With reference to FIGS. 1 through 5, the description below explains the configuration of the valve timing adjusting device 10. The valve timing adjusting device 10 includes an electric motor 11 and a phase adjustment portion 12.

As illustrated in FIG. 1, the electric motor 11 is configured as a brushless motor, for example, and is provided along an extension of an axial direction of the camshaft 91. The electric motor 11 includes a casing 20, a stator and a rotor (unillustrated), and a rotational shaft 21. The casing 20 is fixed to a chain cover 92 of the internal combustion engine 80. The stator and the rotor are included in the casing 20. The rotational shaft 21 is connected to the rotor and is supported by the casing 20 so as to be able to rotate clockwise and counterclockwise. The chain cover 92 is equivalent to a cover member. The casing 20 includes an exposed portion 22 and an insertion portion 23. The exposed portion 22 is provided outside the chain cover 92. The insertion portion 23 is inserted into a through-hole 93 of the chain cover 92. The rotational shaft 21 is provided so as to protrude from the insertion portion 23 to the camshaft 91.

The electric motor 11 further includes an energization control portion (unillustrated) included in the casing 20, for example. The exposed portion 22 includes a connector 24 that electrically connects the energization control portion with an external electronic control unit. The energization control portion includes a driving driver and a corresponding control microcomputer and controls energization to the stator to rotate the rotational shaft 21.

Figure 2:
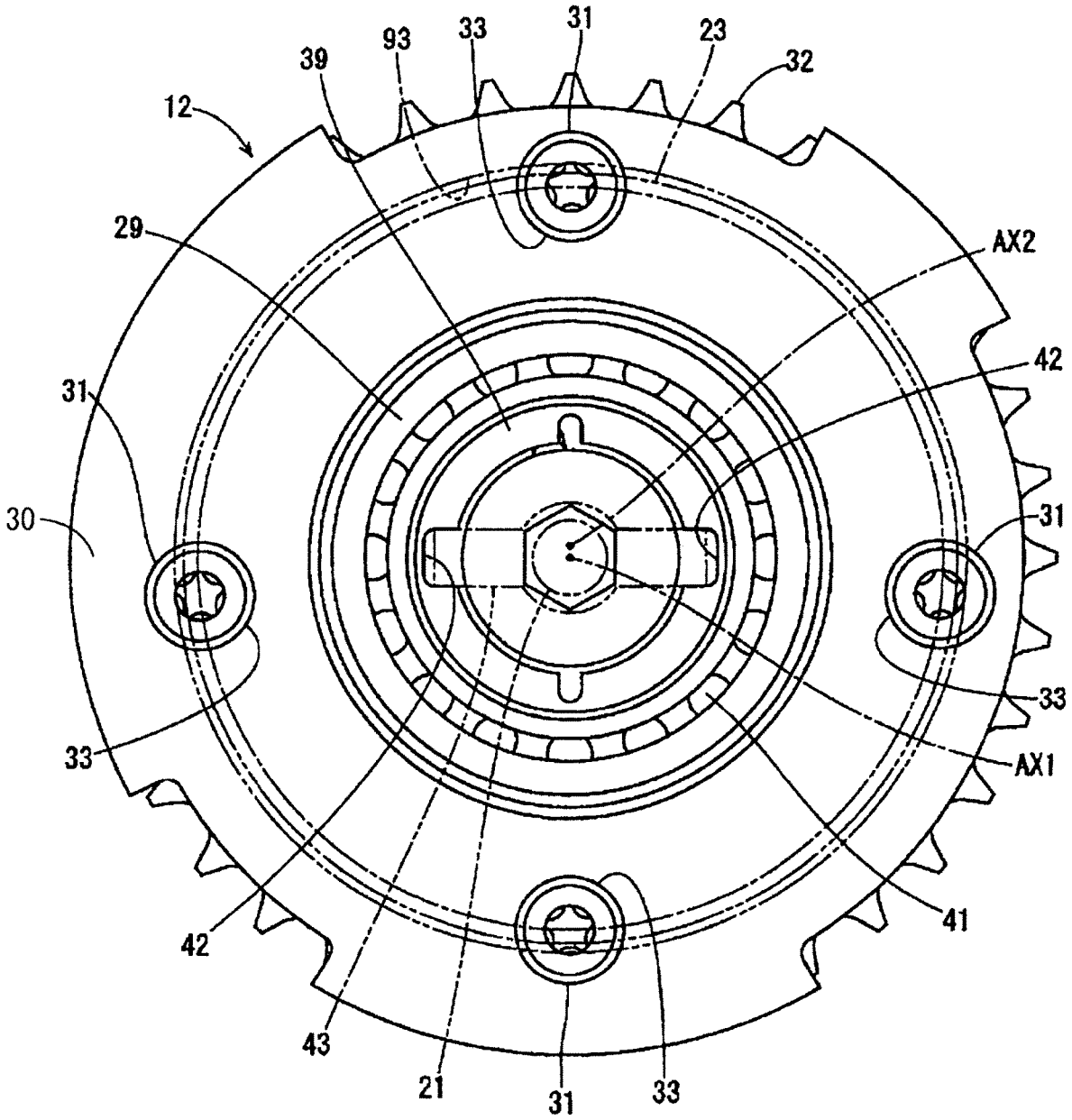
FIG. 2 is a plan view along the line II-II of FIG. 1.

The phase adjustment portion 12 includes a driving rotor 25, a driven rotor 26, and a deceleration mechanism 27. FIG. 2 is a plan view of the phase adjustment portion 12 viewed from the chain cover 92.

The driving rotor 25 is configured by using a bolt 31 to fasten a bottomed cylindrical first housing 28, a second housing 29, and a signal plate 30 provided at a rotational shaft center AX1 of the camshaft 91. The first housing 28 includes a sprocket 32 formed integrally with an outside wall. The first housing 28 is connected to the crankshaft 90 by installing a circular timing chain 95 on the sprocket 32 and a sprocket 94 of the crankshaft 90. The connected driving rotor 25 rotates in conjunction with the crankshaft 90 when the engine torque of the crankshaft 90 is transmitted to the sprocket 32 via the timing chain 95. The driving rotor 25 is designed to rotate clockwise in FIGS. 2 through 4.

The signal plate 30 is a disk-shaped member that allows an unillustrated cam angle sensor to detect a rotation angle of the camshaft 91. FIG. 2 illustrates the phase adjustment portion 12 viewed from the chain cover 92. As illustrated in FIG. 2, the signal plate 30 entirely covers the second housing 29.

Figure 5:
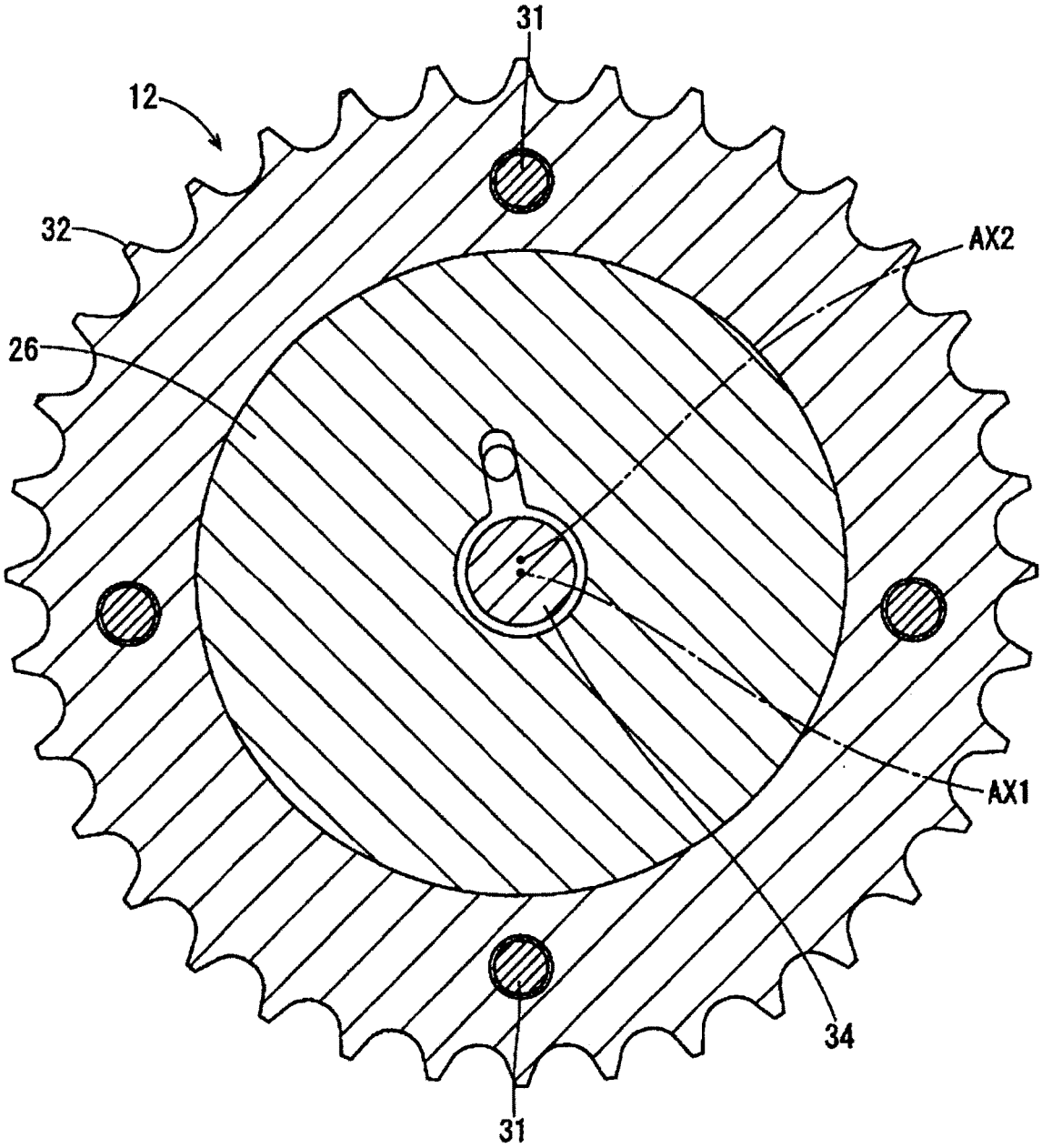
FIG. 5 is a cross-sectional view taken along the line V-V of FIG. 1.

As illustrated in FIGS. 1 and 5, the driven rotor 26 is configured to be a bottomed cylindrical appearance. The driven rotor 26 engages with the inside of a peripheral wall portion of the first housing 28 so as to be able to rotatable relatively to the driving rotor 25. A bottom wall portion of the driven rotor 26 is directly screwed to the end of the camshaft 91 by using a center bolt 34. The screwed driven rotor 26 rotates in conjunction with the camshaft 91. Similarly to the driving rotor 25, the driven rotor 26 is designed to rotate clockwise in FIG. 5.

Figure 4:
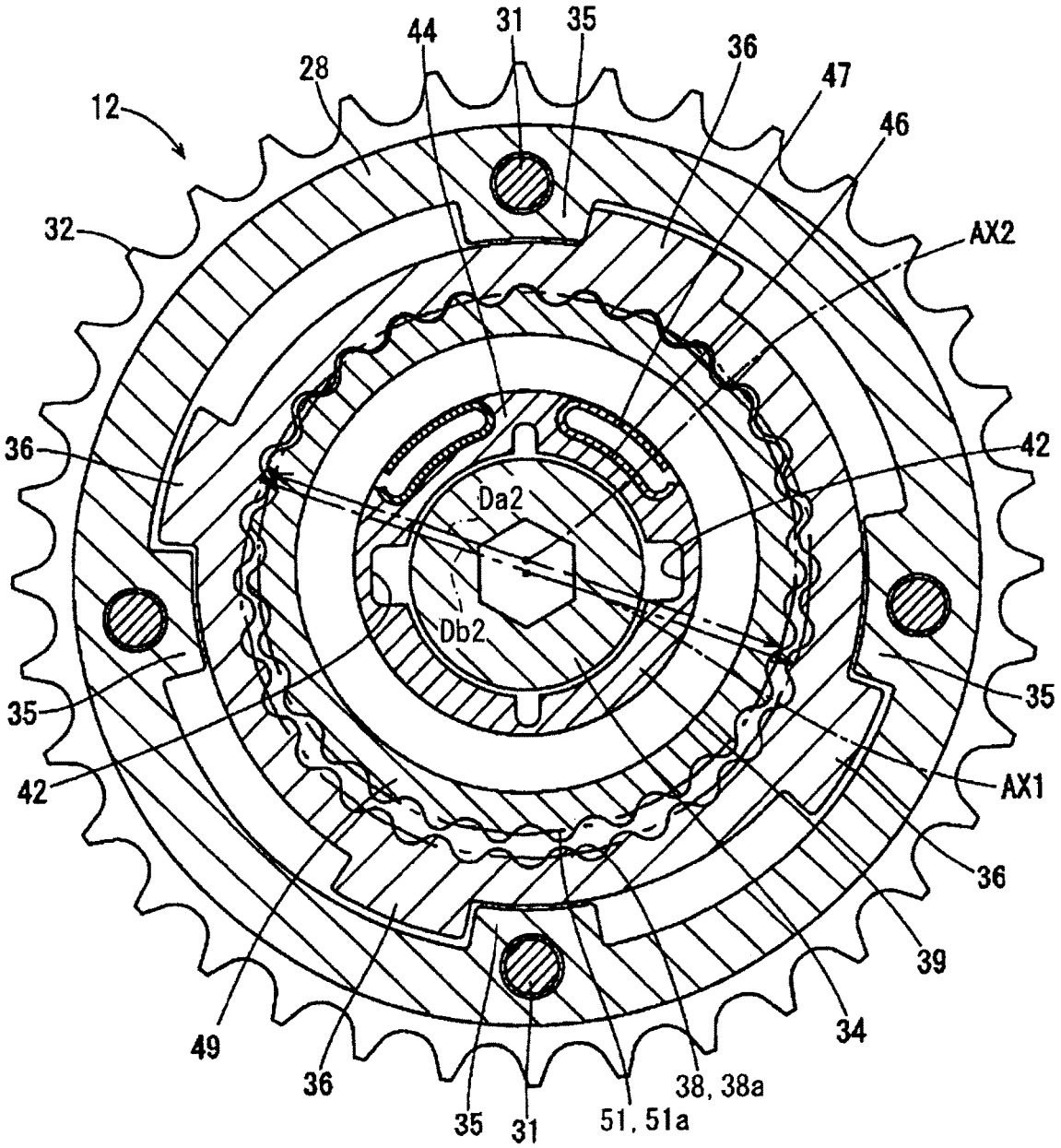
FIG. 4 is a cross-sectional view taken along the line IV-IV of FIG. 1.

As illustrated in FIG. 4, the driving rotor 25 and the driven rotor 26 are provided with a driving stopper portion 35 and a driven stopper portion 36, respectively. The driving stopper portion 35 protrudes inward in a radial direction at four locations on the peripheral wall portion of the first housing 28. The driven stopper portion 36 protrudes outward in a radial direction at four locations on the peripheral wall portion of the driven rotor 26.

As illustrated in FIG. 4, when the specific driven stopper portion 36 comes into contact with the driving stopper portion 35 toward an ignition retard angle, the relative rotation of the driven rotor 26 is prevented toward the ignition retard angle with reference to the driving rotor 25. An outermost end phase at the ignition retard angle regulates the phase between the driving rotor 25 and the driven rotor 26. A phase between the driving rotor and the driven rotor is hereinafter referred to as an "inter-rotor phase." According to the present embodiment, the outermost end phase at the ignition retard angle is set to an initial phase to permit the start of the internal combustion engine 80. When the specific driven stopper portion 36 comes into contact with the driving stopper portion 35 toward an ignition advance angle, the relative rotation of the driven rotor 26 is prevented toward the ignition advance angle with reference to the driving rotor 25. An outermost end phase at the ignition advance angle regulates the inter-rotor phase.

As illustrated in FIGS. 1 through 4, the deceleration mechanism 27 is configured as a 2K-H planetary gear mechanism. The deceleration mechanism 27 includes a driving internal gear portion 37, a driven internal gear portion 38, an input rotor 39, and a planetary rotor 40.

The driving internal gear portion 37 is provided integrally with an inside wall of the peripheral wall portion of the second housing 29. A shaft center of the driving internal gear portion 37 corresponds to the rotational shaft center AX1. The driving internal gear portion 37 includes a plurality of internal teeth 37*a* extending inward in a radial direction. The bolt 31 is provided at a position in a circumferential direction equal to that of a tooth tip of the driving internal gear portion 37. The present embodiment provides four bolts 31 at irregular intervals in the circumferential direction.

Figure 3:
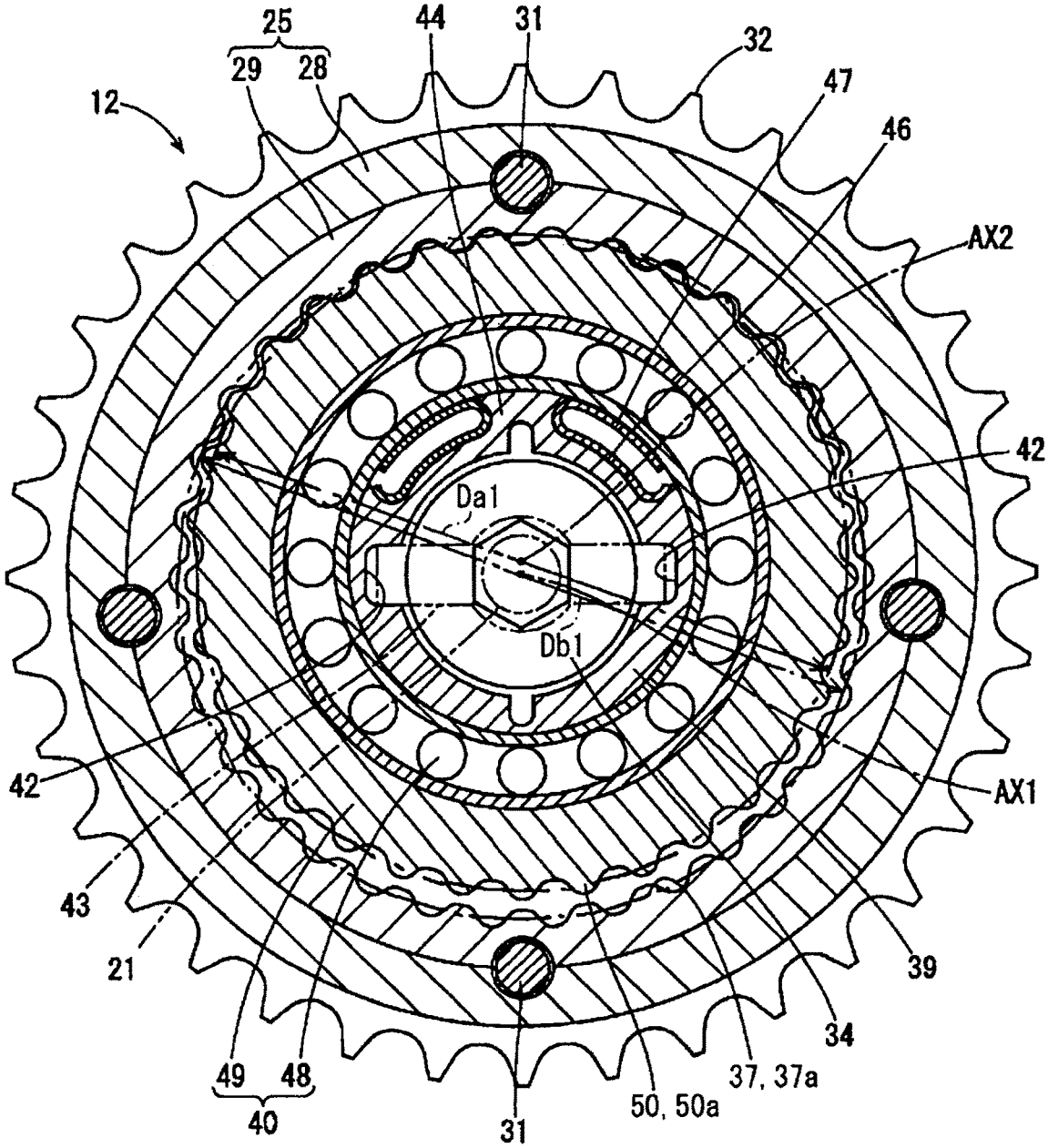
FIG. 3 is a cross-sectional view taken along the line III-III of FIG. 1.

The driven internal gear portion 38 is provided integrally with an inside wall of the peripheral wall portion of the driven rotor 26. A shaft center of the driven internal gear portion 38 corresponds to the rotational shaft center AX1. The driven internal gear portion 38 includes a plurality of internal teeth 38*a* extending inward in a radial direction. A diameter of the driven internal gear portion 38 is smaller than a diameter of the driving internal gear portion 37. The number of teeth of the driven internal gear portion 38 is smaller than the number of teeth of the driving internal gear portion 37. As illustrated in FIG. 3, pitch circle inner diameter Db1 represents a pitch circle diameter of the driving internal gear portion 37. As illustrated in FIG. 4, pitch circle inner diameter Db2 represents a pitch circle diameter of the driven internal gear portion 38. Pitch circle inner diameter Db1 is larger than pitch circle inner diameter Db2.

The input rotor 39 is approximately shaped into a cylinder as an external view and is rotatably supported by the second housing 29 about the rotational shaft center AX1 via a bearing 41. The bearing 41 is provided for a bottom wall portion of the second housing 29. A pair of fitting grooves 42 is formed on an inside wall of the input rotor 39. The fitting groove 42 extends in an axial direction and is opened inward in a radial direction. The fitting groove 42 extends from one end face of the input rotor 39 to the other end face. The fitting groove 42 engages with a joint 43 of the rotational shaft 21 and thereby couples the input rotor 39 with the rotational shaft 21. The coupled input rotor 39 can rotate along with the rotational shaft 21.

The input rotor 39 also includes an eccentricity portion 44 that is eccentric about the rotational shaft center AX1. The eccentricity portion 44 includes a pair of recessed portions 46 toward an eccentric side of the eccentricity portion 44. The recessed portions 46 are opened outward in a radial direction. The recessed portions 46 contain a resilient member 47 to generate a restoring force. According to the present embodiment, the resilient member 47 is configured as a metal leaf spring having an approximately U-shaped sectional view.

The planetary rotor 40 is configured by combining a planetary bearing 48 and a planetary gear 49. An inner race of the planetary bearing 48 is placed outside the eccentricity portion 44 of the input rotor 39 with a predetermined clearance. The planetary bearing 48 is supported by the eccentricity portion 44 from the inside via each resilient member 47 and transmits the restoring force received from each resilient member 47 to the planetary gear 49.

The planetary gear 49 is shaped into a stepped cylinder and is supported by the eccentricity portion 44 so as to be able to rotate about an eccentric shaft center AX2 via the planetary bearing 48. A large-diameter portion of the planetary gear 49 corresponds to a driving external gear portion 50 that engages with the driving internal gear portion 37. A small-diameter portion of the planetary gear 49 corresponds to a driven external gear portion 51 that engages with the driven internal gear portion 38. The driving external gear portion 50 and the driven external gear portion 51 include a plurality of external teeth 50*a* and 51*a* extending outward in a radial direction, respectively. The number of teeth of the driving external gear portion 50 and the number of teeth of the driven external gear portion 51 are smaller than the number of teeth of the driving internal gear portion 37 and the number of teeth of the driven internal gear portion 38 so as to leave the same number of teeth as a difference. As illustrated in FIG. 3, pitch circle outer diameter Da1 represents a pitch circle diameter of the driving external gear portion 50. As illustrated in FIG. 4, pitch circle outer diameter Da2 represents a pitch circle diameter of the driven external gear portion 51. Pitch circle outer diameter Da1 is larger than pitch circle outer diameter Da2.

When the input rotor 39 rotates about the rotational shaft center AX1, the planetary gear 49 performs a sun-and-planet motion while rotating about the eccentric shaft center AX2 and revolving about the rotational shaft center AX1. The rotation speed of the planetary gear 49 is decelerated in comparison with the revolution speed of the input rotor 39. The driven internal gear portion 38 and the driven external gear portion 51 are equivalent to a transmission means to transmit the rotation of the planetary gear 49 to the driven rotor 26.

According to the present embodiment, the driving internal gear portion 37 and the driven internal gear portion 38 are each equivalent to a subordinate concept of the internal gear portion in the present disclosure. The driving external gear portion 50 and the driven external gear portion 51 are each equivalent to a subordinate concept of the external gear portion in the present disclosure. The driving internal gear portion 37 and the driving external gear portion 50 are each equivalent to a subordinate concept of a pair of gear portions in the present disclosure. The driven internal gear portion 38 and the driven external gear portion 51 are each equivalent to a subordinate concept of a pair of gear portions in the present disclosure.

The phase adjustment portion 12 configured as above decelerates the relative rotation of the electric motor 11 with reference to the driving rotor 25, converts the relative rotation into a relative rotation of the driven rotor 26 with reference to the driving rotor 25, and thereby adjusts the inter-rotor phase as a phase between the rotors 25 and 26. Specifically, the rotational shaft 21 rotates at the same speed as the driving rotor 25. When the input rotor 39 does not perform relative rotation with reference to the driving rotor 25, the planetary gear 49 rotates in conjunction with the rotors 25 and 26 without performing the sun-and-planet motion. Therefore, the inter-rotor phase is maintained.

The rotational shaft 21 may rotate at a low speed or reversely rotate with reference to the driving rotor 25 and allow the input rotor 39 to perform relative rotation toward the ignition retard angle with reference to the driving rotor 25. In this case, the planetary gear 49 performs sun-and-planet motion and the driven rotor 26 performs relative rotation toward the ignition retard angle with reference to the driving rotor 25. Therefore, the inter-rotor phase retards.

The rotational shaft 21 may rotate at a high speed and allow the input rotor 39 to perform relative rotation toward the ignition advance angle with reference to the driving rotor 25. In this case, the planetary gear 49 performs sun-and-planet motion and the driven rotor 26 performs relative rotation toward the ignition advance angle with reference to the driving rotor 25. Therefore, the inter-rotor phase advances.

Figure 6:
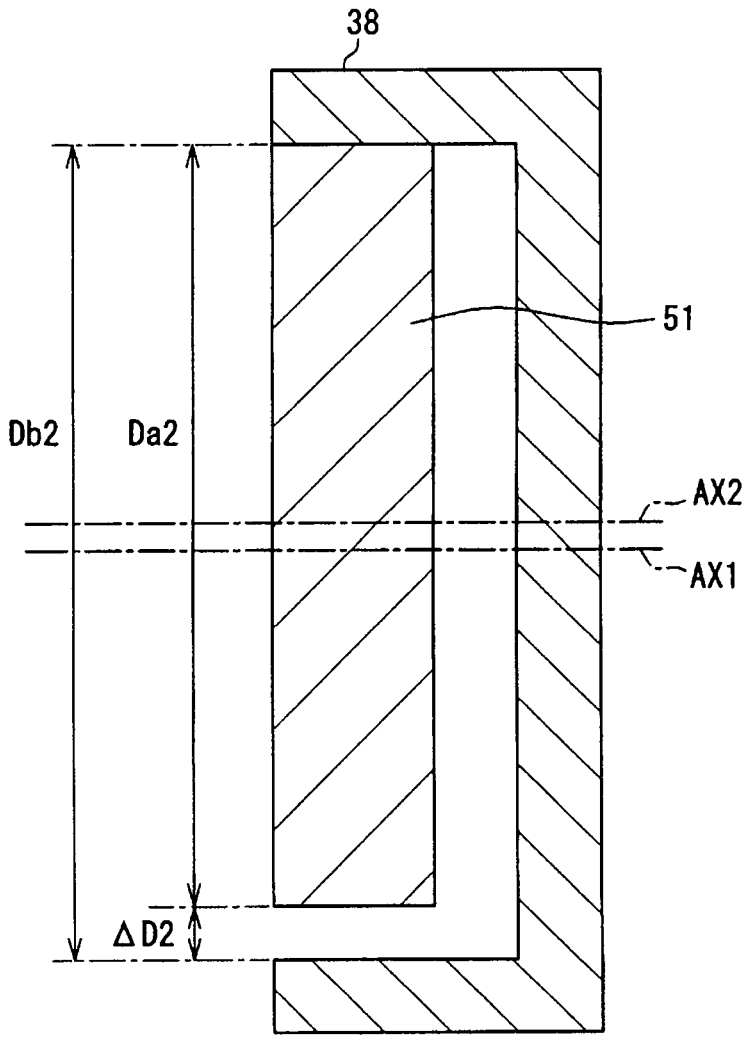
FIG. 6 is an explanatory diagram illustrating an outer diameter difference at a driven side.

Pitch circle outer diameter Da1 of the driving external gear portion 50 is smaller than pitch circle inner diameter Db1 as a pitch circle diameter of the driving internal gear portion 37. Pitch circle outer diameter Da2 of the driven external gear portion 51 is larger than pitch circle inner diameter Db2 as a pitch circle diameter of the driven internal gear portion 38. At the driving side, a difference between pitch circle inner diameter Db1 and pitch circle outer diameter Da1 corresponds to outer diameter difference ΔD1. At the driven side, as illustrated in FIG. 6, a difference between pitch circle inner diameter Db2 and pitch circle outer diameter Da2 corresponds to outer diameter difference ΔD2.

Parts of the valve timing adjusting device 10 are considered to thermally expand. Outer diameter differences ΔD1 and ΔD2 are considered to change when the driving internal gear portion 37, the driven internal gear portion 38, the driving external gear portion 50, and the driven external gear portion 51 thermally expand, for example. The present embodiment provides linear expansion coefficients αb1, αb2, αa1, and αa2 for the driving internal gear portion 37, the driven internal gear portion 38, the driving external gear portion 50, and the driven external gear portion 51, respectively, so that outer diameter differences ΔD1 and ΔD2 decrease as the temperature rises at the driving internal gear portion 37, the driven internal gear portion 38, the driving external gear portion 50, and the driven external gear portion 51.

At the driving side, linear expansion coefficient αa1 of the driving external gear portion 50 is larger than linear expansion coefficient αb1 of the driving internal gear portion 37 so that an increase rate of pitch circle outer diameter Da1 is larger than an increase rate of pitch circle inner diameter Db1. In this case, outer diameter difference ΔD1 decreases as the temperature rises. At the driven side, linear expansion coefficient αa2 of the driven external gear portion 51 is larger than linear expansion coefficient αb2 of the driven internal gear portion 38 so that an increase rate of pitch circle outer diameter Da2 is larger than an increase rate of pitch circle inner diameter Db2. In this case, outer diameter difference ΔD2 decreases as the temperature rises.

According to the present embodiment, linear expansion coefficient αa1 of the driving external gear portion 50 is equal to linear expansion coefficient αa2 of the driven external gear portion 51. The same steel material such as S45C is used to form the driving external gear portion 50 and the driven external gear portion 51. Linear expansion coefficient αb1 of the driving internal gear portion 37 is equal to linear expansion coefficient αb2 of the driven internal gear portion 38. The same steel material such as SUS440C is used to form the driving internal gear portion 37 and the driven internal gear portion 38. According to the present embodiment, the driving internal gear portion 37, the driven internal gear portion 38, the driving external gear portion 50, and the driven external gear portion 51 are assumed to be heated and cooled similarly. The driving internal gear portion 37, the driven internal gear portion 38, the driving external gear portion 50, and the driven external gear portion 51 are assumed to keep the same temperature.

When the increase rate of pitch circle outer diameters Da1 and Da2 may be larger than the increase rate of pitch circle inner diameters Db1 and Db2, the excess temperature rise at the valve timing adjusting device 10 may cause pitch circle outer diameters Da1 and Da2 to be larger than pitch circle inner diameters Db1 and Db2. The present embodiment configures linear expansion coefficients αb1, αb2, αa1, and αa2 so that the thermal expansion does not hinder the sun-and-planet motion of the planetary gear 49.

Figure 7:
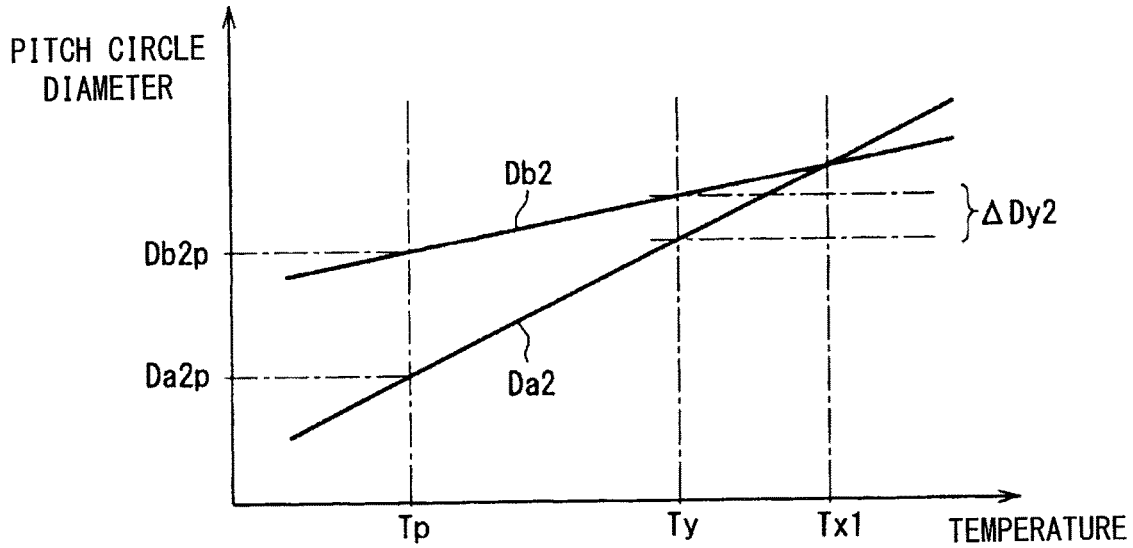
FIG. 7 is an explanatory diagram illustrating increase rates of a pitch circle outer diameter and a pitch circle inner diameter.
Figure 8:
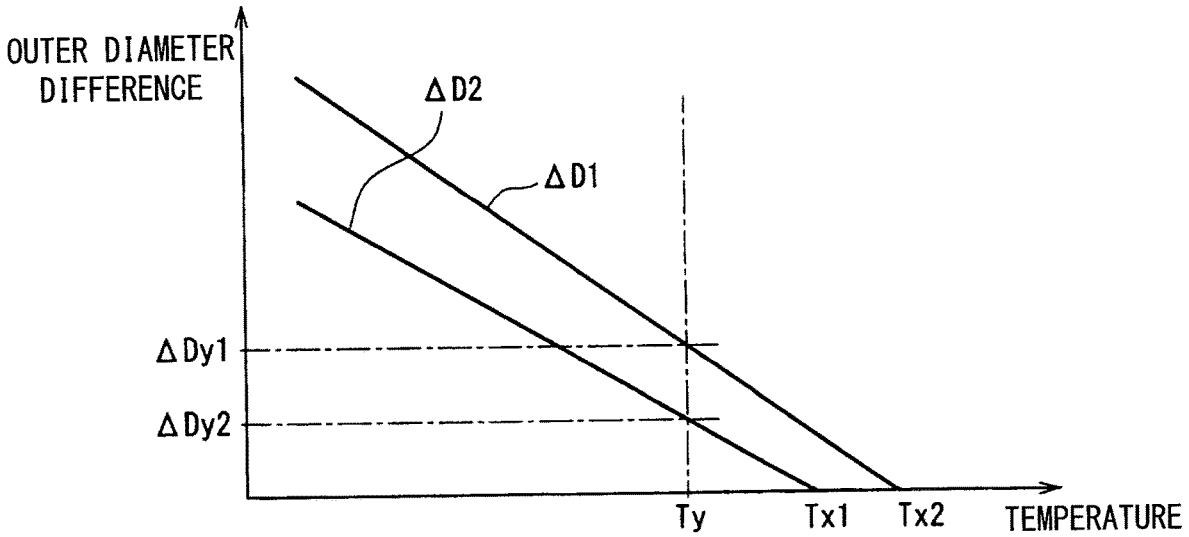
FIG. 8 is an explanatory diagram illustrating modes of change in an outer diameter difference between an internal gear portion and an external gear portion.

The description below explains the terminal expansion at the driven side, for example. As illustrated in FIG. 7, the increase rate for pitch circle outer diameter Da2 of the driven external gear portion 51 is greater than the increase rate for pitch circle inner diameter Db2 of the driven internal gear portion 38. In such a case, pitch circle outer diameter Da2 may catch up with pitch circle inner diameter Db2 at temperature Tx1. As illustrated in FIG. 8, outer diameter difference ΔD2 decreases and may go to zero at the above-described temperature Tx1 as the temperature rises at the driven external gear portion 51 and the driven internal gear portion 38.

When outer diameter difference ΔD2 is smaller than a predetermined value although pitch circle outer diameter Da2 does not increase to reach pitch circle inner diameter Db2, the external tooth 51*a* is expected to accidentally come into contact with the internal tooth 38*a* in a region where the driven external gear portion 51 does not engage with the driven internal gear portion 38. As illustrated in FIGS. 7 and 8 according to the present embodiment, limit diameter difference ΔDy2 represents the possibly smallest value for outer diameter difference ΔD2 within a range where the external tooth 51*a* does not accidentally come into contact with the internal tooth 38*a*. Limit temperature Ty represents the temperature at which outer diameter difference ΔD2 decreases to reach limit diameter difference ΔDy2. The valve timing adjusting device 10 uses steel materials and other materials selected for the driving internal gear portion 37, the driven internal gear portion 38, the driving external gear portion 50, and the driven external gear portion 51 so that the normal operation of the internal combustion engine 80 causes limit temperature Ty to be higher than the temperature (such as 130° C.) the driving internal gear portion 37, the driven internal gear portion 38, the driving external gear portion 50, and the driven external gear portion 51 can reach.

At the driving side similar to the driven side, outer diameter difference ΔD1 decreases as the temperature rises at the driving external gear portion 50 and the driving internal gear portion 37. As illustrated in FIG. 8, outer diameter difference ΔD1 at the driving side goes to zero at temperature Tx2 higher than the above-described temperature Tx1. At the driving side, limit diameter difference ΔDy1 represents outer diameter difference ΔD1 at limit temperature Ty. Then, limit diameter difference ΔDy2 at the driven side is smaller than limit diameter difference ΔDy1 at the driving side. When the driving internal gear portion 37, the driven internal gear portion 38, the driving external gear portion 50, and the driven external gear portion 51 reach limit temperature Ty, a collision between the driven external gear portion 51 and the driven internal gear portion 38 is more likely to occur than a collision between the driving external gear portion 50 and the driving internal gear portion 37. When the driven side is configured to collide more easily, the driven side instead of the driving side just needs to manage the thermal expansion for the pair of gear portions including the driven external gear portion 51 and the driven internal gear portion 38 in order to inhibit a rattling sound resulting from a collision between the external gear portion 50 or 51 and the internal gear portion 37 or 38. The configuration enables to reduce a burden on the design of the valve timing adjusting device 10.

As illustrated in FIG. 7 according to the present embodiment, reference temperature Tp represents the temperature lower than limit temperature Ty. At reference temperature Tp, reference diameter Da2*p* represents pitch circle outer diameter Da2 of the driven external gear portion 51. Reference diameter Db2*p* represents pitch circle inner diameter Db2 of the driven internal gear portion 38. In this case, the driven side is assumed to use linear expansion coefficient αa2 for the driven external gear portion 51 and linear expansion coefficient αb2 for the driven internal gear portion 38. Then, the relationship $Da2p \times \alpha a2 > Db2p \times \alpha b2$ . . . (1) is established. The driven side establishes the relationship that causes a product between reference diameter Da2*p* and linear expansion coefficient αa2 to be larger than a product between reference diameter Db2*p* and linear expansion coefficient αb2.

The driving side is similar to the driven side. At reference temperature Tp, reference diameter Da1*p* represents pitch circle outer diameter Da1 of the driving external gear portion 50. Reference diameter Db1*p* represents pitch circle inner diameter Db1 of the driving internal gear portion 37. In this case, when linear expansion coefficient αa1 for the driving external gear portion 50 and linear expansion coefficient αb1 for the driving internal gear portion 37 are used, the relationship $Da1p \times \alpha a1 > Db1p \times \alpha b1$ . . . (2) is established. The driving side establishes the relationship that causes a product between reference diameter Da1*p* and linear expansion coefficient αa1 to be larger than a product between reference diameter Db1*p* and linear expansion coefficient αb1. Reference temperature Tp is assumed to be the ordinary temperature such as 20° C.

As above, the valve timing adjusting device 10 according to the present embodiment allows linear expansion coefficient αa1 or αa2 of the external gear portion 50 or 51 to be larger than linear expansion coefficient αb1 or αb2 of the internal gear portion 37 or 38. Therefore, outer diameter difference ΔD1 or ΔD2 decreases as the temperature rises at the valve timing adjusting device 10. The consequence is to decrease estimated distance CL1 or CL2 that enables the external gear portion 50 or 51 and the internal gear portion 37 or 38 to move relatively. Estimated distance CL1 or CL2 is ensured between the external tooth 50*a* or 51*a* and the internal tooth 37*a* or 38*a* engaged with each other when the external gear portion 50 or 51 and the internal gear portion 37 or 38 are moved virtually in a radial direction so that the external tooth 50*a* or 51*a* and the internal tooth 37*a* or 38*a* engaged with each other are disengaged. Estimated distance CL1 represents a distance that enables the movement at the driving side. Estimated distance CL2 represents a distance that enables the movement at the driven side.

Figure 9:
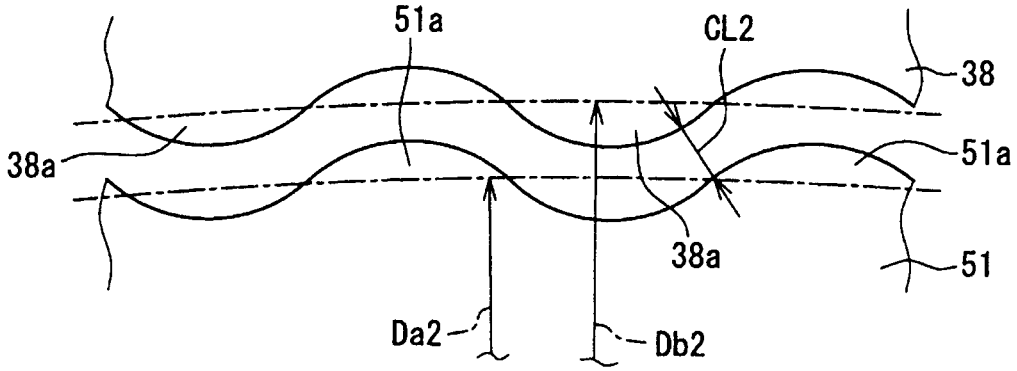
FIG. 9 is an explanatory diagram illustrating an estimated distance before the temperature rises.
Figure 10:
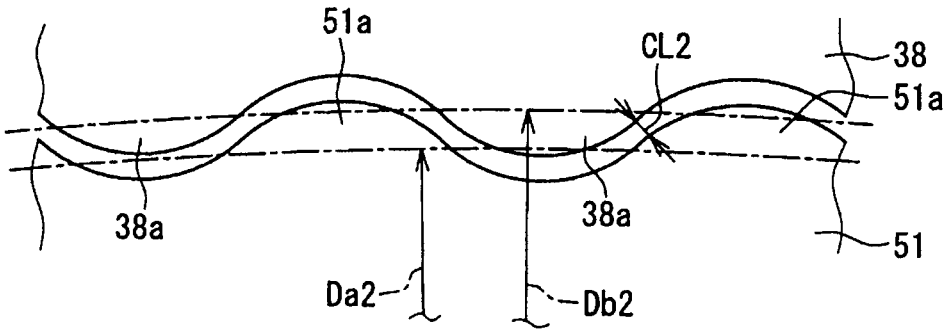
FIG. 10 is an explanatory diagram illustrating an estimated distance after the temperature rises.

With reference to FIGS. 9 and 10, the description below explains estimated distance CL2, for example. Supposing that the driven external gear portion 51 and the driven internal gear portion 38 are engaged with each other before the virtual movement, estimated distance CL2 represents the shortest distance between the external tooth 51*a* and the internal tooth 38*a* corresponding to the driven external gear portion 51 and the driven internal gear portion 38 after the virtual movement in FIGS. 9 and 10. FIG. 9 illustrates estimated distance CL2 when the temperature is sufficiently decreased in lubricating oil for the valve timing adjusting device 10 during the cold start of the internal combustion engine 80. In this case, the viscosity of the lubricating oil is large. The lubricating oil tends to regulate the relative movement between the driven external gear portion 51 and the driven internal gear portion 38. Even when estimated distance CL2 is large to some degree, it is hard to increase the momentum when a collision occurs between the driven external gear portion 51 and the driven internal gear portion 38.

FIG. 10 illustrates estimated distance CL2 when the temperature is increased in the lubricating oil for the valve timing adjusting device 10 during operation of the internal combustion engine 80. In this case, estimated distance CL2 is smaller than estimated distance CL2 at the cold start because linear expansion coefficient αa2 for the driven external gear portion 51 is larger than linear expansion coefficient αb2 for the driven internal gear portion 38. Even when the viscosity of the lubricating oil decreases as the temperature rises, it is hard to increase the momentum when a collision occurs between the driven external gear portion 51 and the driven internal gear portion 38 because a movement distance between the same is small. The configuration enables to reduce a rattling sound resulting from a collision between the driven external gear portion 51 and the driven internal gear portion 38 regardless of whether the temperature of the valve timing adjusting device 10 is high or low.

The valve timing adjusting device 10 according to the present embodiment allows linear expansion coefficient αa1 or αa2 of the external gear portion 50 or 51 to be larger than linear expansion coefficient αb1 or αb2 of the internal gear portion 37 or 38. As the temperature rises, the configuration enables to decrease outer diameter difference ΔD1 between pitch circle inner diameter Db1 of the driving internal gear portion 37 and pitch circle outer diameter Da1 of the driving external gear portion 50 and outer diameter difference ΔD2 between pitch circle inner diameter Db2 of the driven internal gear portion 38 and pitch circle outer diameter Da2 of the driven external gear portion 51. The configuration enables to decrease estimated distance CL1 or CL2 that enables relative movement between the external gear portion 50 or 51 and the internal gear portion 37 or 38. The configuration enables to inhibit the momentum when a collision occurs between the external gear portion 50 or 51 and the internal gear portion 37 or 38 in a condition where the temperature rises. The configuration enables to inhibit the occurrence of a rattling sound when the valve timing adjusting device 10 is driven.

The present embodiment allows the increase rate for pitch circle outer diameter Da1 or Da2 corresponding to temperature rise at the external gear portion 50 or 51 to be higher than the increase rate for pitch circle inner diameter Db1 or Db2 corresponding to temperature rise at the internal gear portion 37 or 38. There are established the relationships expressed by the above-described equations (1) and (2). The present embodiment takes account of the pitch circle outer diameters Da1 and Da2 and the pitch circle inner diameters Db1 and Db2 in addition to linear expansion coefficients αb1, αb2, αa1, and αa2. The configuration enables to reliably embody the configuration that decreases estimated distances CL1 and CL2 as the temperature rises.

According to the present embodiment, the same value is applied to linear expansion coefficient αa1 for the driving external gear portion 50 and linear expansion coefficient αb1 for the driving internal gear portion 37. In addition, the same value is applied to linear expansion coefficient αa2 for the driven external gear portion 51 and linear expansion coefficient αb2 for the driven internal gear portion 38. The configuration enables to uniformly manage the thermal expansion on the driving side and the thermal expansion on the driven side at a design stage. The configuration enables to easily inhibit the occurrence of an unintended rattling sound or an unexpectedly large rattling sound due to a collision between the external gear portion 50 or 51 and the internal gear portion 37 or 38.

The present embodiment establishes the relationships expressed by the above-described equations (1) and (2) by setting an appropriate ratio between linear expansion coefficient αa1 or αa2 of the external gear portion 50 or 51 and linear expansion coefficient αb1 or αb2 of the internal gear portion 37 or 38. It is unnecessary to assign dedicated values to the sizes of the driving internal gear portion 37, the driven internal gear portion 38, the driving external gear portion 50, and the driven external gear portion 51. There is no need to change sizes at the design stage of the valve timing adjusting device 10. The configuration enables to inhibit an increase in the costs incurred by the design work.

B. Second Embodiment

Figure 11:
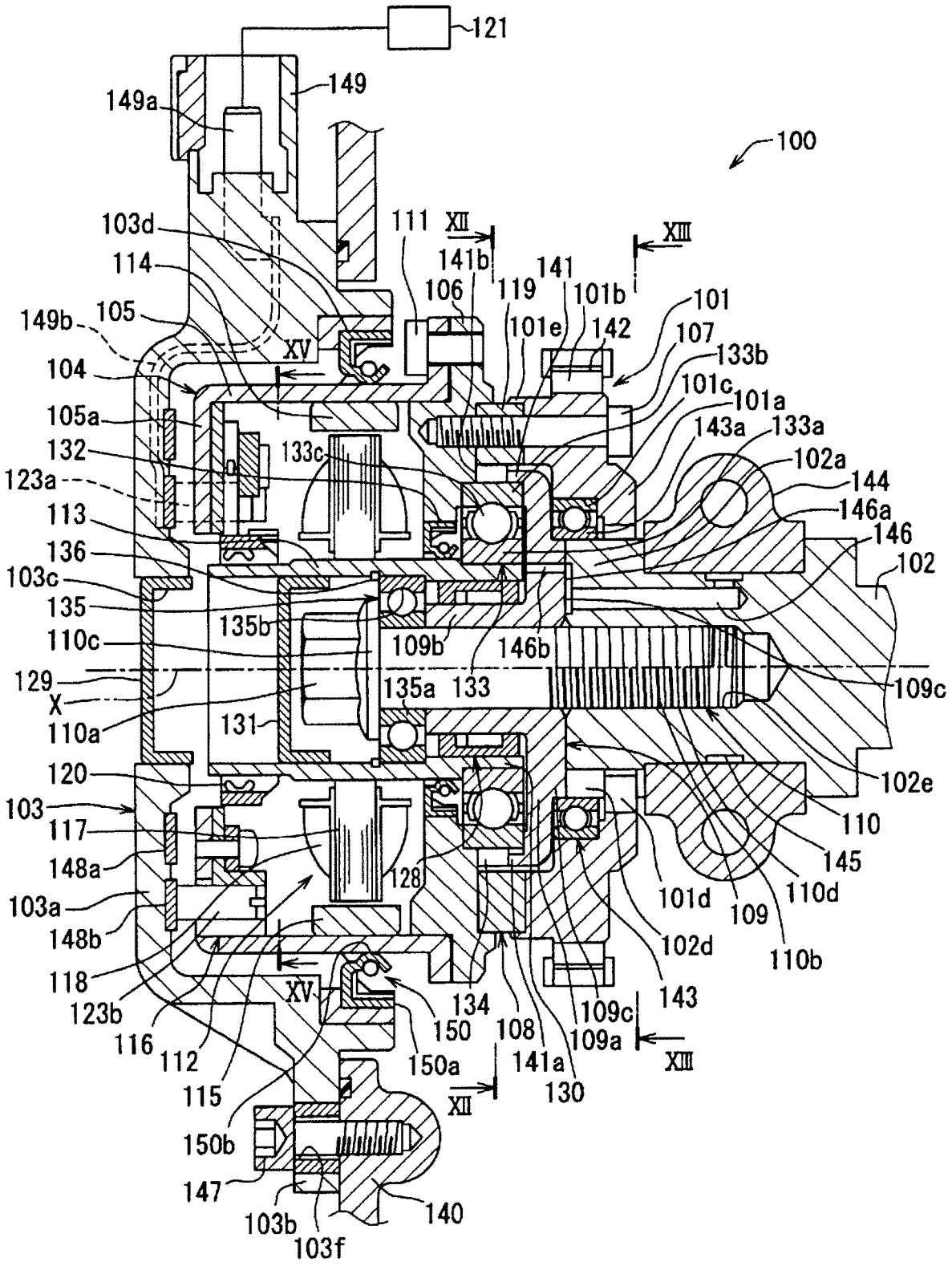
FIG. 11 is a cross-sectional view illustrating a schematic configuration of a valve timing adjusting device according to a second embodiment.

As illustrated in FIG. 11, a valve timing adjusting device 100 according to a second embodiment differs from the valve timing adjusting device 10 according to the first embodiment in that the deceleration mechanism 27 is replaced by a deceleration mechanism 108. The deceleration mechanism 108 differs from the deceleration mechanism 27 according to the first embodiment in that the planetary gear 49 is replaced by a roller mechanism including a plurality of rollers 134.

The valve timing adjusting device 100 as illustrated in FIGS. 11 through 15 includes a sprocket 101, a camshaft 102, a cover member 103, and a phase changing portion 104. The sprocket 101 provides a driving rotor that rotates driven by the crankshaft of an unillustrated internal combustion engine. The camshaft 102 is rotatably supported over an unillustrated cylinder head via a bearing 144, rotates due to a rotational force transmitted from the sprocket 101, and is equivalent to a camshaft. The cover member 103 provides a securing member that is placed in front of the sprocket 101 and is bolted to a chain cover 140. The phase changing portion 104 is placed between the sprocket 101 and the camshaft 102 and changes a relative rotational phase between the sprocket 101 and the camshaft 102 according to an engine operation state. The chain cover 140 is bolted to the cylinder head.

The sprocket 101 includes an annular base portion 101*a* and a gear portion 101*b*. The base portion 101*a* is integrally formed of ferrous metal and includes an inner periphery formed to provide stepped diameters. The gear portion 101*b* is integrally provided for an outer periphery of the base portion 101*a* and receives a rotational force from the crankshaft via the installed timing chain 142. A circular base groove 101*c* is formed at an inner periphery of the base portion 101*a*. A thick flange portion 102*a* is integrally provided at the front end of the camshaft 102. A second ball bearing 143 is provided between the base groove 101*c* and an outer periphery of the flange portion 102*a*. The camshaft 102 rotatably supports the sprocket 101 by using the second ball bearing 143.

Figure 13:
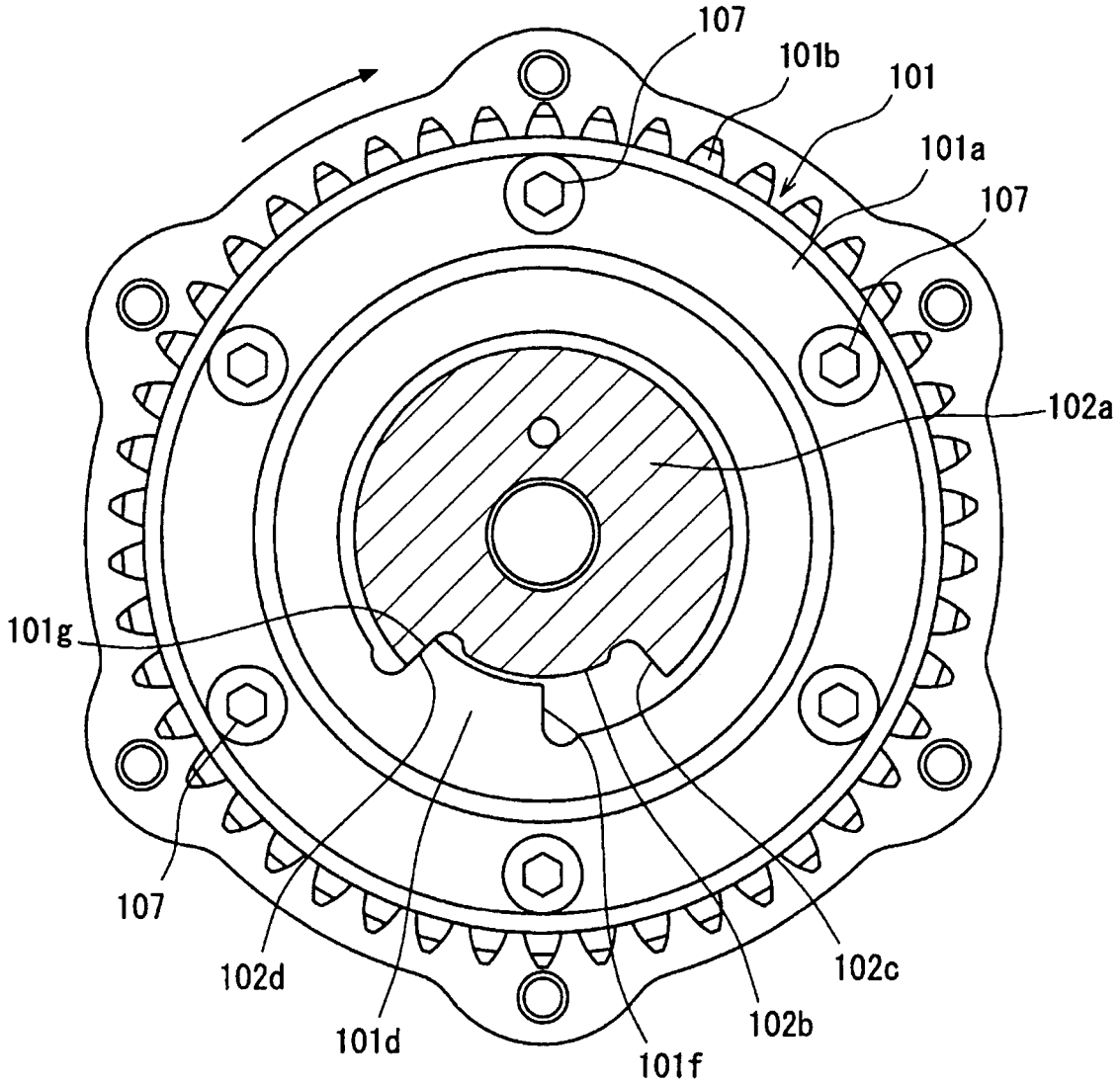
FIG. 13 is a cross-sectional view taken along the line XIII-XIII of FIG. 11.

An annular base protrusion 101*e* is integrally provided for an outer periphery edge at the front end of the base portion 101*a*. A circular member 119 is placed at the front end of the base portion 101*a* and is coaxially positioned at an inner periphery of the base protrusion 101*e*. A bolt 107 jointly fastens a large-diameter annular plate 106 at the fore-end face of the circular member 119 in an axial direction. As illustrated in FIG. 13, the inner periphery of the base portion 101*a* partially forms a stopper protrusion portion 101*d* as a rounded engaging portion within a specified length in a circumferential direction.

The inner periphery of the circular member 119 forms an internal tooth 119*a* as a corrugated engaging portion. A bolt 111 fastens a cylindrical housing 105 to the outer periphery of the plate 106 at the front end. The housing 105 configures part of an electric motor 112 (to be described) for the phase changing portion 104.

The housing 105 made of ferrous metal is formed into a right-angled U-shape as a sectional view and functions as a yoke. The housing 105 integrally includes a holding portion 105*a* like an annular plate at the bottom side as the front end. The cover member 103 entirely covers the outer periphery of the housing 105 including the holding portion 105*a* by leaving a specified gap.

On the outer periphery, the camshaft 102 includes two drive cams per cylinder to open two intake valves per cylinder. A cam bolt 110 couples the camshaft 102 with a driven member 109 as a driven rotor at the front end of the camshaft 102 in an axial direction. An unillustrated valve spring applies a force to each intake valve in a closing direction. A spring force of the valve spring applies positive and negative alternate torque to the camshaft 102.

As illustrated in FIG. 13, a flange portion 102*a* of the camshaft 102 forms a stopper groove 102*b* in a circumferential direction. The stopper protrusion portion 101*d* of the base portion 101*a* fits into the stopper groove 102*b*. The stopper groove 102*b* is formed to be rounded having a specified length in the circumferential direction. The camshaft 102 rotates within the length. End edges 101*f* and 101*g* of the stopper protrusion portion 101*d* come into contact with circumferentially facing edges 102*c* and 102*d*, respectively. The stopper groove 102*b* regulates the relative rotation position of the camshaft 102 at the maximum ignition advance angle or the maximum ignition retard angle with reference to the sprocket 101.

As illustrated in FIG. 13, when the camshaft 102 rotates and allows its one facing edge 102*d* to come into contact with one end edge 101*g* of the sprocket 101, the relative rotational phase corresponds to the maximum ignition retard angle. When the other facing edge 102*c* comes into contact with the other end edge 101*f* and is regulated, the relative rotational phase corresponds to the maximum ignition advance angle. The stopper protrusion portion 101*d* and the stopper groove 102*b* configure a stopper mechanism.

The cam bolt 110 includes a head portion 110*a* and a shaft portion 110*b* integrated with the head portion 110*a*. A flange-like seating face portion 110*c* is integrally formed at the end edge of the head portion 110*a* corresponding to the shaft portion 110*b*. A male thread portion 110*d* is formed on the outer periphery of the shaft portion 110*b* and is screwed on a female thread portion 102*e* that is formed inward in an axial direction from the front end edge of the camshaft 102.

The driven member 109 is made of a ferrous metal material and is integrally formed. As illustrated in FIG. 11, the driven member 109 includes a circular plate portion 109*a* formed at the posterior end and a cylindrical cylinder portion 109*b* formed integrally with the fore-end face of the circular plate portion 109*a*.

The circular plate portion 109*a* is integrally provided with an annular stepped protrusion 109*c* approximately at the center of the rear end face in a radial direction. The stepped protrusion 109*c* has an external diameter approximately the same as the flange portion 102*a* of the camshaft 102. The circular plate portion 109*a* is inserted into an inner periphery of the inner race 143*a* of the second ball bearing 143 while the outer periphery of the stepped protrusion 109*c* confronts the outer periphery of the flange portion 102*a*. The configuration enables to facilitate the shaft alignment of the camshaft 102 and the driven member 109 during the assembly. An outer ring 143*b* of the second ball bearing 143 is press-fit to the inner periphery of the base groove 101*c* of the base portion 101*a*.

Figure 12:
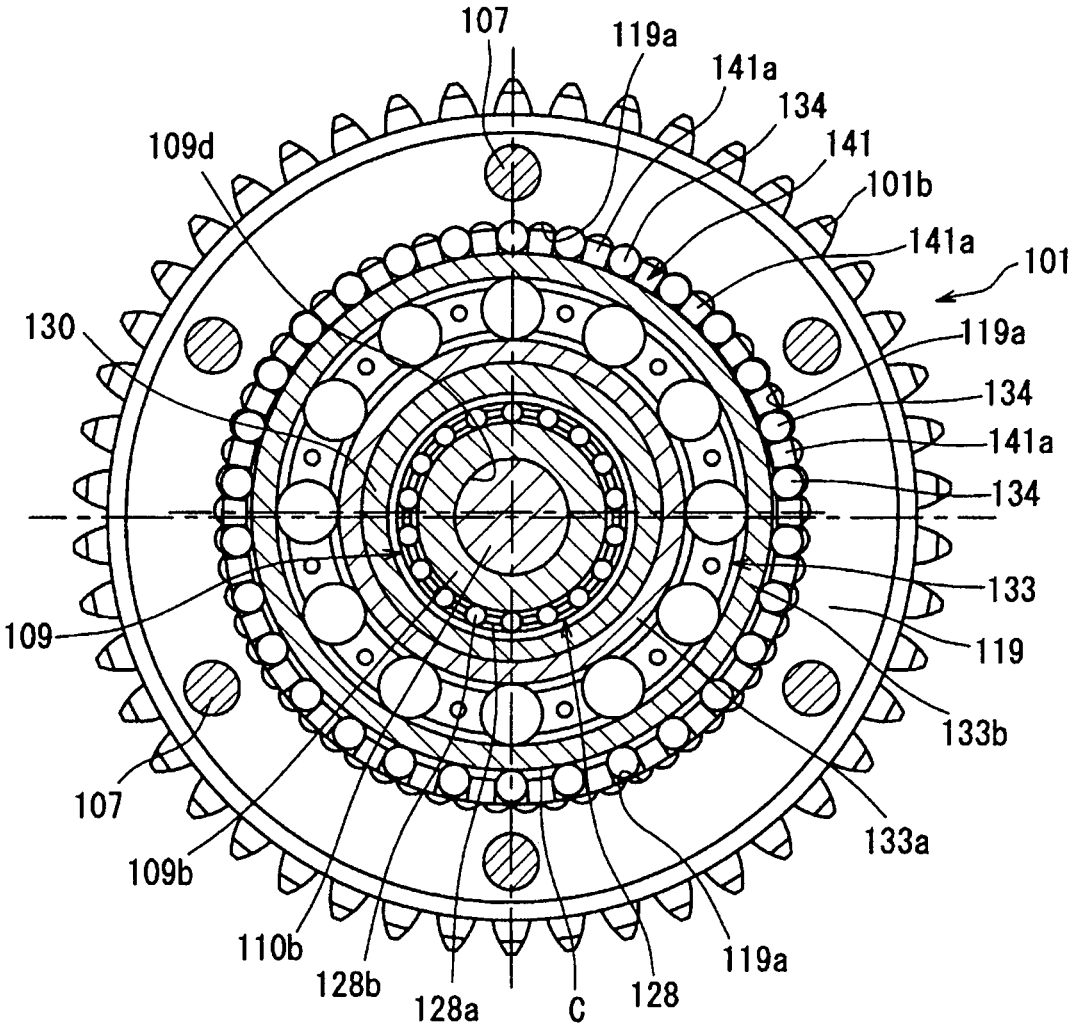
FIG. 12 is a cross-sectional view taken along the line XII-XII of FIG. 11.

As illustrated in FIGS. 11 and 12, the outer periphery of the circular plate portion 109*a* is integrally provided with a retainer 141 as a holding member that holds a roller 134 (to be described) as a rolling element. The retainer 141 includes a plurality of protruding portions 141*a*. The protruding portion 141*a* is formed to protrude from an annular base portion formed integrally with the outer periphery of the circular plate portion 109*a* in the same direction as the cylinder portion 109*b*, namely, in the axial direction of the cylinder portion 109*b*. Each protruding portion 141*a* as a roller holding portion is formed like a comb and is formed into a rectangle viewed as a transverse section. The protruding portions 141*a* are formed at approximately regular intervals leaving a specified gap in a circumferential direction of the annular base portion.

As illustrated in FIG. 11, an insertion hole 109*d* is formed to pierce through the cylinder portion 109*b* so that the shaft portion 110*b* of the cam bolt 110 is inserted at the center. The cylinder portion 109*b* is provided with a needle bearing 128 (to be described) at the outer periphery.

Figure 15:
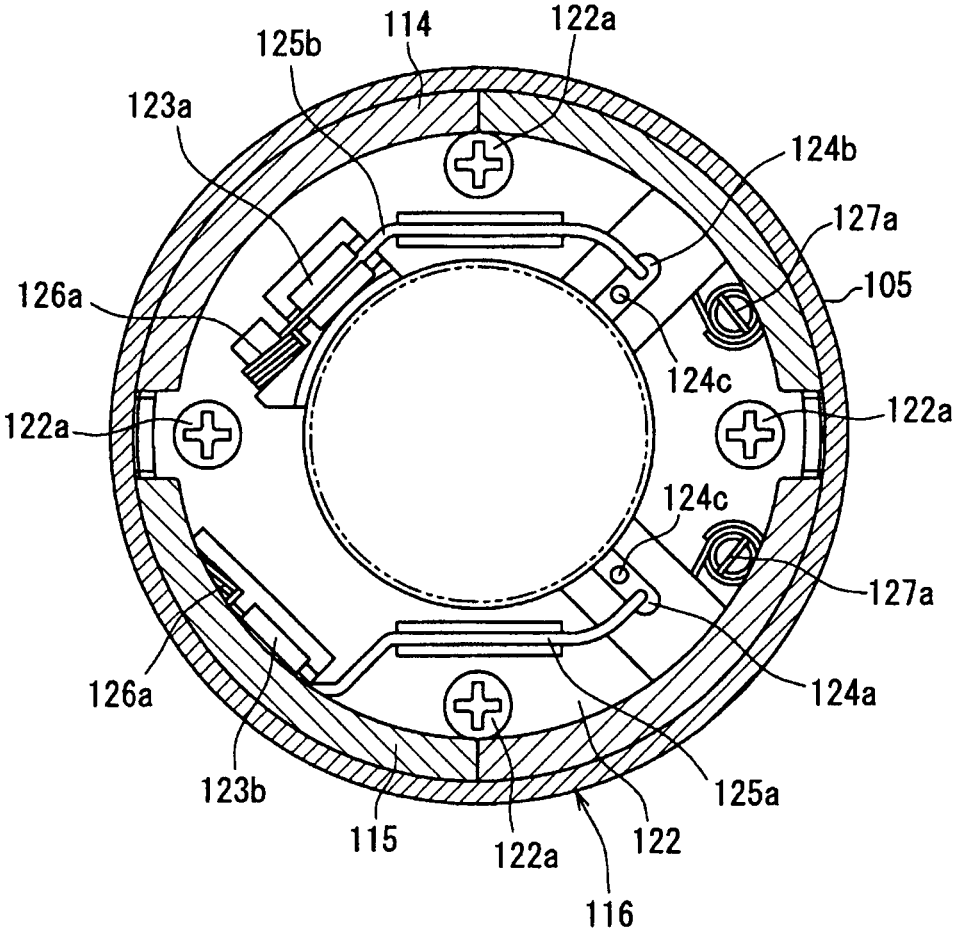
FIG. 15 is a cross-sectional view taken along the line XV-XV of FIG. 11.

As illustrated in FIGS. 11 and 15, the cover member 103 is integrally formed of a non-magnetic synthetic resin material and includes a cover body 103*a* and a bracket 103*b*. The cover body 103*a* bulges like a cup. The bracket 103*b* is integrally provided at the posterior end of the cover body 103*a* on the outer periphery.

The cover body 103*a* covers the front end of the phase changing portion 104. The cover body 103*a* is placed so as to almost entirely cover the housing 105 from the holding portion 105*a* at the front end to the rear end by leaving a specified gap. A working hole 103*c* is formed approximately at the center of an almost flat front end wall to pierce through. The working hole 103*c* is used to coaxially align the oil seal 150 with the phase changing portion 104. After the assembly is completed, a first plug portion 129 approximately formed into a right-angled U-shape viewed as a transverse section is tightly fit into the working hole 103*c* to obstruct the inside. The bracket 103*b* includes a bolt insertion hole 103*f* that is formed to pierce through each of six bosses formed almost annularly.

As illustrated in FIG. 11, the cover member 103 is fastened to the chain cover 140 by using a plurality of bolts 147 inserted into the insertion holes 103*f* in the bracket 103*b*. Double slip rings 148*a* and 148*b* inside and outside allow each inner end face to be exposed and are embedded in and fastened to the inner periphery of the front end wall of the cover body 103*a*. The slip rings 148*a* and 148*b* are each formed into a thin annular plate and are placed inside and outside by leaving a specified gap. Each outer end in an axial direction is embedded in and is fastened to the inside of the front end wall.

The cover member 103 includes a connector portion 149 at the top end. The connector portion 149 includes a long-plate connector terminal 149*a* whose base end is embedded in and fastened to the cover member 103. The connector portion 149 is embedded in and fastened to the cover member 103. The connector portion 149 includes a crank-like conductive member 149*b* that allows its one end to be connected to the base end of the connector terminal 149*a* and its other end to be connected to the slip rings 148*a* and 148*b*. A controller 121 turns on or off energization to the connector terminal 149*a* from an unillustrated battery power supply.

Figure 14:
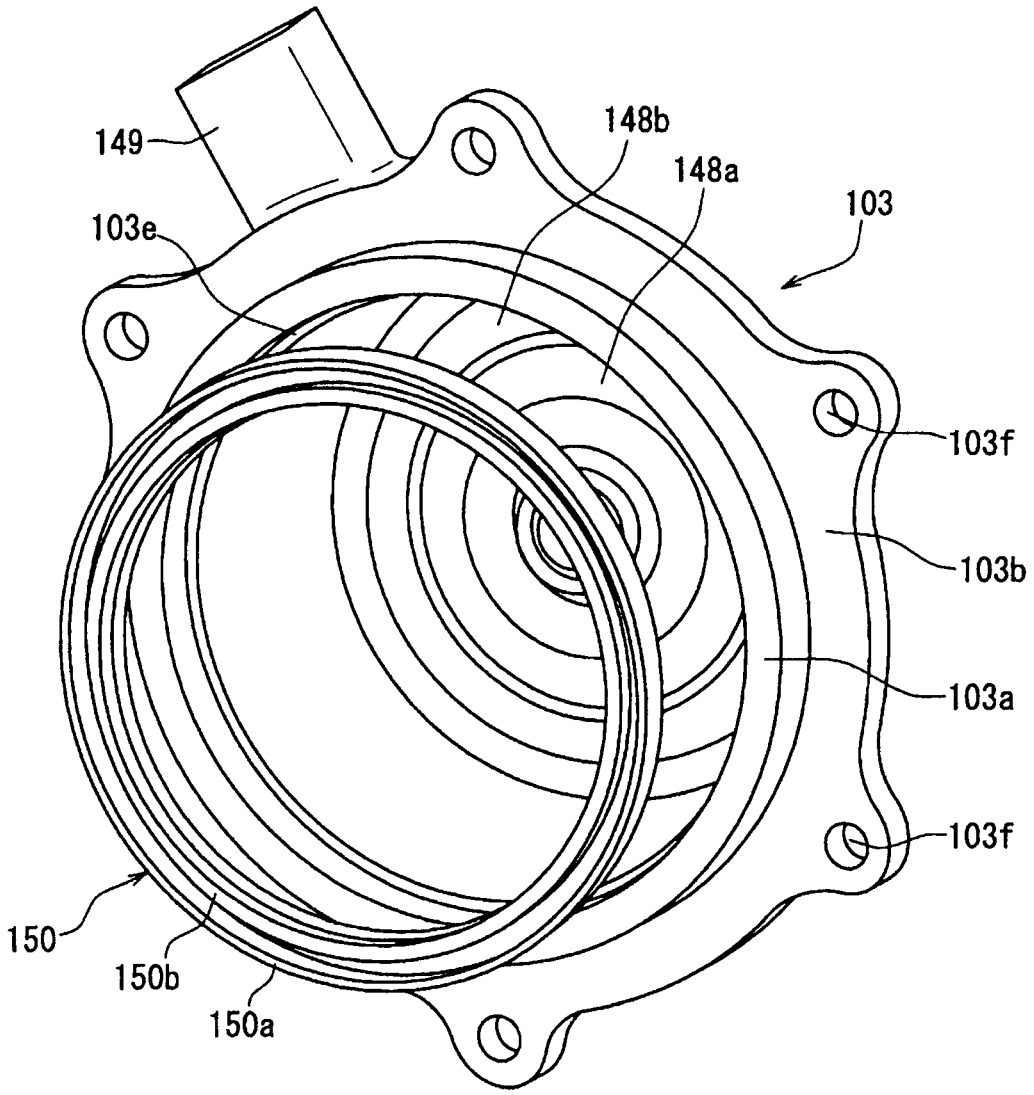
FIG. 14 is an exploded perspective view of a cover member and a first oil seal.

As illustrated in FIGS. 11 and 14, a large-diameter first oil seal 150 as a seal member is inserted between the inner periphery of the cover body 103*a* at the rear end and the outer periphery of the housing 105. The first oil seal 150 is approximately formed into a right-angled U-shape viewed as a transverse section. A cored bar is embedded in a base material made of synthetic rubber. An annular base portion 150*a* on the outer periphery is tightly fit into a circular groove 103*d* formed on the inner periphery at the rear end of the cover member 103. The inner periphery of the annular base portion 150*a* integrally forms a seal face 150*b* that comes into contact with the outer periphery of the housing 105.

The phase changing portion 104 includes the electric motor 112 and the deceleration mechanism 108. The electric motor 112 is approximately coaxially placed at the front end of the camshaft 102. The deceleration mechanism 108 decelerates a revolution speed of the electric motor 112 and transmits the revolution speed to the camshaft 102.

As illustrated in FIG. 11, the electric motor 112 is configured as a brush DC motor. The electric motor 112 includes the housing 105, a motor output shaft 113, a pair of semi-circular permanent magnets 114 and 115, and a stator 116. The housing 105 is provided as a yoke and rotates integrally with the sprocket 101. The motor output shaft 113 is rotatably provided inside the housing 105. The permanent magnets 114 and 115 are fastened to the inner periphery of the housing 105. The stator 116 is provided at the inner bottom of the housing holding portion 105*a*.

The motor output shaft 113 is cylindrically formed and functions as an armature. An iron-core rotor 117 having a plurality of poles is fastened to the outer periphery of the motor output shaft 113 approximately at the center in the axial direction. A magnet coil 118 is wound around the outer periphery of the iron-core rotor 117. A commutator 120 is press-fit to the outer periphery of the motor output shaft 113 at the front end. The magnet coil 118 is harnessed to each of the segments of the commutator 120. The number of the segments is equal to the number of poles of the iron-core rotor 117. A second plug portion 131 is approximately formed into a right-angled U-shape viewed as a transverse section and is press-fit inside the motor output shaft 113 to obstruct the inside after the cam bolt 110 is fastened. The oil is thereby prevented from leaking unlimitedly.

As illustrated in FIG. 15, the stator 116 mainly includes a resin holder 122, first brushes 123*a* and 123*b*, and second brushes 124*a* and 124*b*. The resin holder 122 is shaped into an annular plate and is fastened to an inner bottom wall of the holding portion 105*a* by using four screws 122*a*. The two first brushes 123*a* and 123*b* are placed to pierce the resin holder 122 and the holding portion 105*a* in the axial direction and are provided inward and outward in the circumferential direction for power supply. The two first brushes 123*a* and 123*b* are supplied with the power by allowing each front end face to come in sliding contact with a pair of slip rings 148*a* and 148*b*. The second brushes 124*a* and 124*b* select the energization and are retained at the inner periphery of the resin holder 122 so as to freely move forward and backward inside. The second brushes 124*a* and 124*b* each allow a rounded tip portion to come in sliding contact with the outer periphery of the commutator 120.

Pigtail harnesses 125*a* and 125*b* connect the first brushes 123*a* and 123*b* and the second brushes 124*a* and 124*b*. Torsion springs 126*a* and 127*a* come in resilient contact with the brushes and apply a spring force to the brushes to be pressed toward the slip rings 148*a* and 148*b* and the commutator 120.

As illustrated in FIG. 11, the motor output shaft 113 is rotatably supported around the cam bolt 110 by using the needle bearing 128 and a third ball bearing 135. The needle bearing 128 is provided at the outer periphery of the cylinder portion 109*b* of the driven member 109. The third ball bearing 135 is provided at the outer periphery of the shaft portion 110*b* at the seating face portion 110*c* of the cam bolt 110. An eccentric shaft portion 130 is provided integrally with the rear end of the motor output shaft 113 toward the camshaft 102. The eccentric shaft portion 130 is provided as a cylindrical eccentric rotor and configures part of the deceleration mechanism 108.

As illustrated in FIG. 12, the needle bearing 128 includes a cylindrical retainer 128*a* and a plurality of needle rollers 128*b*. The retainer 128*a* is pressed into the inner periphery of the eccentric shaft portion 130. The needle rollers 128*b* are rotatably retained inside the retainer 128*a*. The needle rollers 128*b* roll over the outer periphery of the cylinder portion 109*b* of the driven member 109.

The third ball bearing 135 allows the inner race 135*a* to be sandwiched between the front end edge of the cylinder portion 109*b* of the driven member 109 and the seating face portion 110*c* of the cam bolt 110. The outer ring 135*b* is sandwiched between a stepped portion formed on the inner periphery of the motor output shaft 113 and a snap ring 136 as a retaining ring in the axial direction so as to be positioned and retained.

A second oil seal 132 is provided between the outer periphery of the motor output shaft 113 and the inner periphery of the plate 106. The second oil seal 132 prevents the lubricating oil from leaking into the electric motor 112 from the inside of the deceleration mechanism 108. In addition to the sealing function, the second oil seal 132 comes in resilient contact with the outer periphery of the motor output shaft 113 and thereby applies the frictional resistance to the rotation of the motor output shaft 113.

The controller 121 detects the current engine operation state and controls the ignition timing and the injection quantity based on information signals from various sensors such as a crank angle sensor, a cam angle sensor, an airflow meter, a water temperature sensor, and an accelerator position sensor. The crank angle sensor detects rotation positions of the crankshaft. The cam angle sensor detects rotation positions of the camshaft 102. The airflow meter detects the intake air.

The controller 121 detects a relative rotation angle phase between the crankshaft and the camshaft 102 based on detection signals output from the crank angle sensor and the cam angle sensor. Based on the detection signals, the controller 121 energizes the magnet coil 118 of the electric motor 112 and controls the motor output shaft 113 to rotate forward or backward. The controller 121 allows the deceleration mechanism 108 to control the relative rotational phase of the camshaft 102 with reference to the sprocket 101.

As illustrated in FIGS. 11 and 12, the deceleration mechanism 108 includes the eccentric shaft portion 130, a first ball bearing 133, the roller 134, the retainer 141, and the driven member 109. The eccentric shaft portion 130 is a member that performs eccentric rotation motion. The first ball bearing 133 is a rotation member that is provided for the outer periphery of the eccentric shaft portion 130. The roller 134 corresponds to a plurality of rolling elements provided for the outer periphery of the first ball bearing 133. The retainer 141 is a member that retains the roller 134 in a rolling direction and permits the movement in a radial direction. The driven member 109 is provided integrally with the retainer 141.

The eccentric shaft portion 130 is formed into a cylinder. Shaft center Y of a cam face formed on the outer periphery is slightly eccentric to the radial direction from rotational shaft center X of the motor output shaft 113.

The first ball bearing 133 is formed to provide a large diameter and is placed to almost totally overlap with the needle bearing 128 at the radial direction location. The first ball bearing 133 retains a plurality of balls 33*c* to roll freely between an inner race 133*a* and an outer ring 133*b*. The inner race 133*a* is press-fit to the outer periphery of the eccentric shaft portion 130. The roller 134 is always in contact with the outer periphery of the outer ring 133*b*. As illustrated in FIG. 12, a crescent-shaped annular gap C is formed on the outer periphery of the outer ring 133*b*. The gap C allows the first ball bearing 133 as a whole to be able to move in a radial direction or eccentrically in accordance with the eccentric rotation of the eccentric shaft portion 130. The first ball bearing 133 and the eccentric shaft portion 130 are configured as an eccentric rotor.

Each roller 134 is formed into a solid column made of a metal material and is selected as specified from a plurality of rollers previously formed to have different external diameters (to be described). As the outer ring 133*b* of the first ball bearing 133 eccentrically moves along the outer periphery, the rollers 134 corresponding to a specified region come into contact with the inner periphery. The outer periphery partially engages with the internal tooth 119*a* of the circular member 119. The rollers 134 move in the radial direction in synchronization with the eccentric movement of the first ball bearing 133. The rollers 134 are guided by the protruding portions 141*a* of the retainer 141 and concurrently oscillate in the radial direction.

As above, the retainer 141 includes a plurality of protruding portions 141*a* at regular intervals in the circumferential direction and closes one end of the protruding portions 141*a* in the axial direction, namely, the side of the driven member 109. The retainer 141 opens the side opposite the driven member 109. The plate 106 closes an opening 141*b* when jointly fastened with the bolt 107.

As illustrated in FIG. 12 at the bottom, the rollers 134 partly do not engage with the internal teeth 119*a* of the circular member 119 depending on eccentric positions of the first ball bearing 133. In this case, the rollers 134 disengage from the internal teeth 119*a* and are each positioned at a top land between the internal teeth 119*a* or are incompletely engaged. The top of FIG. 12 illustrates a region that completely engages with each internal tooth 119*a*. Even this region produces a minute clearance between an inner face 19*b* of the internal tooth 119*a* and the outer periphery of the roller 134. The configuration enables to ensure the rolling property of the rollers 134 and noise reduction or controlled response of VTC.

A lubricating oil supply means supplies the lubricating oil to the inside of the deceleration mechanism 108. As illustrated in FIG. 11, the lubricating oil supply means includes an oil supply channel 145, an oil supply hole 146, an oil groove 146*a*, and an oil supply hole 146*b*. The oil supply channel 145 is shaped into an annular groove and is formed on the outer periphery of a journal of the camshaft 102 supported by the bearing 144 of the cylinder head. The oil supply hole 146 is formed inside the camshaft 102 in the axial direction and connects to the oil supply channel 145. The oil groove 146*a* is formed at the front end face of the camshaft 102 and is connected to the downstream end of the oil supply hole 146. The oil supply hole 148*b* is small and is formed to pierce the inside of the driven member 109 in the axial direction and allows one end to be opened at the oil groove 146*a* and the other end to be opened near the needle bearing 128 and the first ball bearing 133. The lubricating oil supply means includes three oil discharge holes (unillustrated). The oil discharge hole is large and is formed to pierce the driven member 109.

The oil supply channel 145 allows a main oil gallery (unillustrated) formed inside the cylinder head to always supply the lubricating oil from an oil pump. Therefore, the sufficient lubricating oil is always supplied to the needle bearing 128, the first ball bearing 133, the internal tooth 119*a* of the circular member 119, the rollers 134, and the protruding portions 141*a* of the retainer 141.

According to the present embodiment, the sprocket 101 corresponds to a subordinate concept of the driving rotor in the present disclosure. The driven member 109 corresponds to a subordinate concept of the driven rotor in the present disclosure. The first ball bearing 133 corresponds to a subordinate concept of the inner rotor in the present disclosure. The circular member 119, the first ball bearing 133, the plurality of rollers 134, and the retainer 141 correspond to a subordinate concept of the pair of the roller mechanisms in the present disclosure. Shaft center Y corresponds to a subordinate concept of the eccentric shaft center in the present disclosure.

The description below explains the basic operations of the valve timing adjusting device 100 according to the present embodiment. When the engine crankshaft is driven to rotate, the sprocket 101 rotates via the timing chain 142. The rotational force is transmitted to the housing 105 of the electric motor 112 via the circular member 119 and the plate 106. The permanent magnets 114 and 115 and the stator 116 rotate synchronously. The rotational force of the circular member 119 is transmitted from the roller 134 to the camshaft 102 via the retainer 141 and the driven member 109. Then, the camshaft 102 rotates at a revolution speed half the revolution speed of the crankshaft. The cam on the outer periphery opens the intake valve against the spring force of the valve spring.

During normal operation after the engine starts, a control signal from the controller 121 supplies the power to the magnet coil 118 of the electric motor 112 from a battery power supply via the slip rings 148*a* and 148*b*. The motor output shaft 113 is controlled to rotate forward and backward. The rotational force is transmitted to the camshaft 102 via the deceleration mechanism 108 to control the relative rotational phase with reference to the sprocket 101.

The motor output shaft 113 rotates to eccentrically rotate the eccentric shaft portion 130. Then, the rollers 134 are guided in the radial direction on the side of each protruding portion 141*a* of the retainer 141 each time the motor output shaft 113 rotates once. While guided, the roller 134 surmounts one internal tooth 119*a* of the circular member 119, then rolls to another adjacent internal tooth 119*a*, and successively repeats this movement to contactually roll in the circumferential direction. The contactual roll of each roller 134 decelerates the rotation of the motor output shaft 113 and transmits the rotational force to the camshaft 102 via the driven member 109. The number of rollers 134 can set a reduction ratio as needed. An increase in the number of rollers 134 decreases the reduction ratio. A decrease in the number of rollers 134 increases the reduction ratio.

The camshaft 102 is allowed to rotate forward and backward relative to the sprocket 101 and convert the relative rotational phase, converting the valve timing of the intake valve to the ignition advance angle or the ignition retard angle.

As above, the maximum position of the camshaft 102 rotating forward and backward relative to the sprocket 101 is regulated by allowing each end edge 101*f* and 101*g* of the stopper protrusion portion 101*d* to come into contact with one of the facing edges 102*c* and 102*d* of the stopper groove 102*b*.

The driven member 109 rotates along with the camshaft 102 and rotates in the same direction as the rotation direction of the sprocket 101 as illustrated by the arrow in FIG. 13 in synchronization with the eccentric rotation of the eccentric shaft portion 130. The other facing edge 102*c* of the stopper groove 102*b* comes into contact with the other end edge 101*f* of the stopper protrusion portion 101*d* to regulate the further rotation in the same direction. As a result, the camshaft 102 is forced to maximally change the rotational phase relative to the sprocket 101 to the ignition advance angle.

When the driven member 109 rotates in the direction reverse to the rotation direction of the sprocket 101, one facing edge 102*d* of the stopper groove 102*b* comes into contact with one end edge 101*g* of the stopper protrusion portion 101*d* to regulate the further rotation in the same direction. The camshaft 102 is thereby forced to maximally change the rotational phase relative to the sprocket 101 to the ignition retard angle.

As a result, the valve timing of the intake valve is maximally converted to the ignition advance angle or the ignition retard angle, improving the fuel consumption or output of the engine.

The stopper mechanism using the stopper protrusion portion 101*d* and the stopper groove 102*b* can reliably regulate relative rotation positions of the camshaft 102.

Similarly to the valve timing adjusting device 10 according to the first embodiment, the valve timing adjusting device 100 may allow the components to thermally expand. According to the present embodiment, linear expansion coefficients for the components include linear expansion coefficient $\beta a$ for the roller 134, linear expansion coefficient $\beta b$ for the first ball bearing 133, linear expansion coefficient $\beta c$ for the circular member 119, and linear expansion coefficient $\beta d$ for the retainer 141. Linear expansion coefficient $\beta b$ for the first ball bearing 133 corresponds to the linear expansion coefficient for the outer ring 133*b*. According to the present embodiment, the linear expansion coefficients maintain the relationships $\beta b>\beta d>\beta c$ and $\beta a>\beta d$ in terms of sizes. The circular member 119 and the retainer 141 are formed of a steel material such as SUS440C. The outer ring 133*b* and the roller 134 of the first ball bearing 133 are formed of a steel material such as SUJ2 different from the circular member 119 and the retainer 141.

Figure 16:
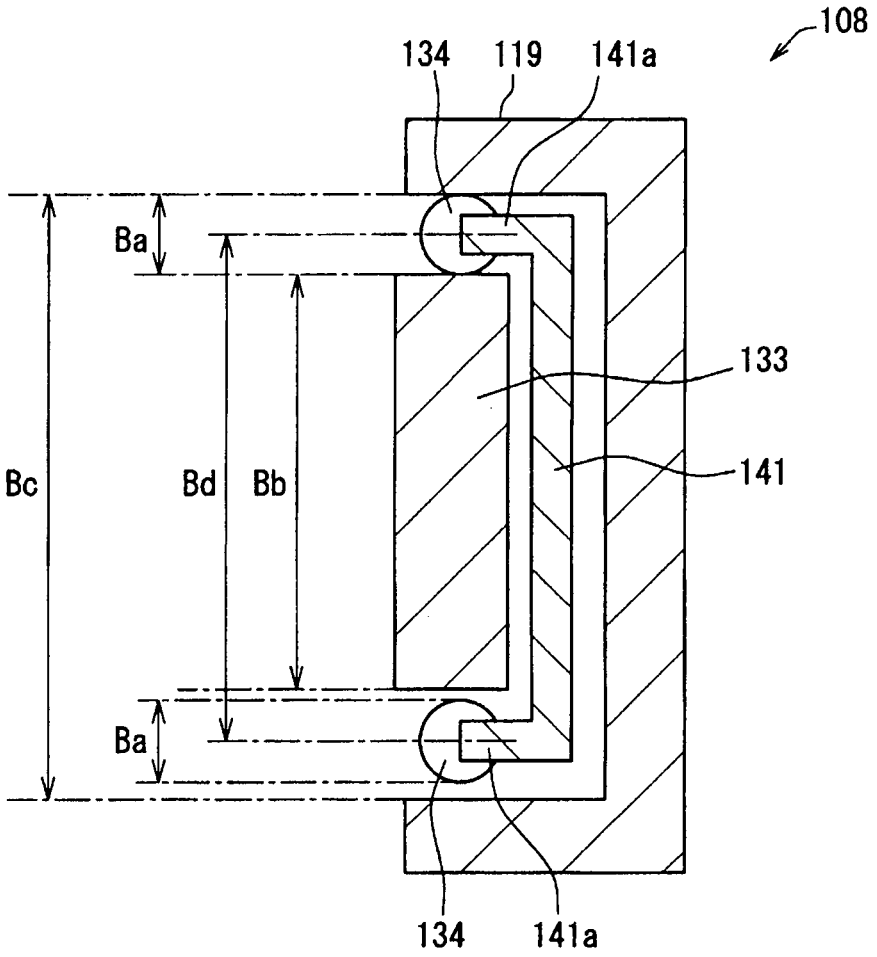
FIG. 16 is an explanatory diagram illustrating sizes of a circular member, a first ball bearing, a roller, and a retainer.

As illustrated in FIG. 16, the roller 134 has outside diameter Ba as a diameter. The circular member 119 has pitch circle inner diameter Bc as a pitch circle diameter. Outside diameter Bb of the first ball bearing 133 corresponds to the outside diameter of the outer ring 133*b* and is smaller than pitch circle inner diameter Bc of the circular member 119. In the retainer 141 according to the present embodiment, centers of the plurality of protruding portions 141*a* are connected to form a virtual circle M (see FIG. 19). The diameter of the virtual circle M is referred to as retaining diameter Bd. Retaining diameter Bd is larger than outside diameter Bb of the first ball bearing 133 and is smaller than pitch circle inner diameter Bc of the circular member 119. Diameter difference $\Delta B1$ signifies a difference between outside diameter Bb of the first ball bearing 133 and pitch circle inner diameter Bc of the circular member 119. The virtual circle M may be formed by connecting the inner periphery edges of the protruding portion 141*a* or connecting the outer periphery edges of the same.

Figure 17:
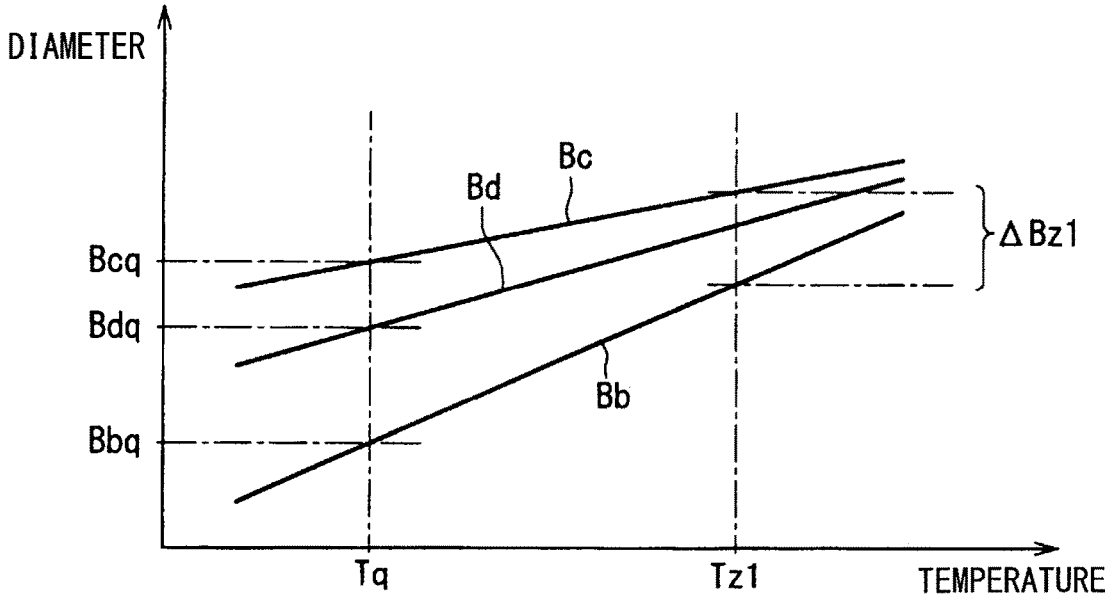
FIG. 17 is an explanatory diagram illustrating increase rates corresponding to sizes of a circular member, a first ball bearing, and a retainer.

Diameter difference $\Delta B1$ is considered to change when the circular member 119 and the first ball bearing 133 thermally expand. The present embodiment specifies linear expansion coefficient $\beta b$ for the first ball bearing 133 and linear expansion coefficient $\beta c$ for the circular member 119 so that diameter difference $\Delta B1$ decreases as the temperature rises on the circular member 119 and the first ball bearing 133. As illustrated in FIG. 17, the increase rate for outside diameter Bb of the first ball bearing 133 is higher than the increase rate for pitch circle inner diameter Bc of the circular member 119. Diameter difference $\Delta B1$ decreases as the temperature rises.

The increase rate for retaining diameter Bd of the retainer 141 is higher than the increase rate for outside diameter Bb of the first ball bearing 133 and is lower than the increase rate for pitch circle inner diameter Bc of the circular member 119. The configuration enables to inhibit a situation where the thermal expansion of the retainer 141 is excessively limited compared to the first ball bearing 133, a difference between outside diameter Bb and retaining diameter Bd excessively decreases, and the relative rotation between the retainer 141 and the first ball bearing 133 is hampered. The configuration enables to inhibit a situation where the retainer 141 excessively expands thermally compared to the circular member 119, a difference between pitch circle inner diameter Bc and retaining diameter Bd decreases excessively, the relative rotation between the retainer 141 and the circular member 119 is hampered.

Figure 18:
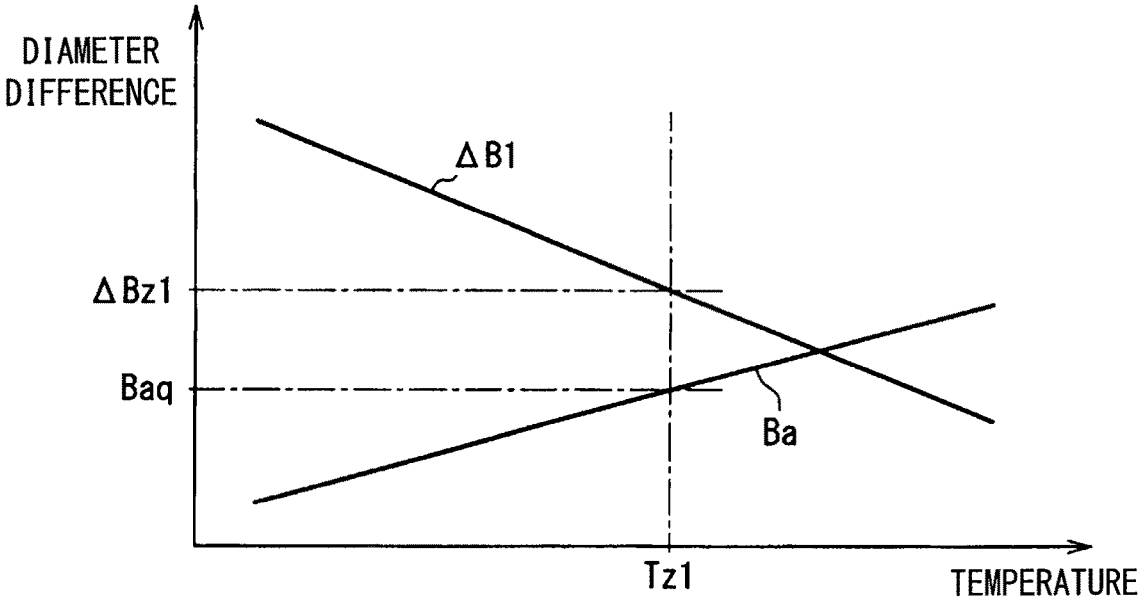
FIG. 18 is an explanatory diagram illustrating modes of change in a diameter difference between a circular member and a first ball bearing.

As illustrated in FIGS. 17 and 18, an increase in the temperature decreases diameter difference $\Delta B1$ between outside diameter Bb of the first ball bearing 133 and pitch circle inner diameter Bc of the circular member 119 and increases outside diameter Ba of the roller 134. Between the first ball bearing 133 and the circular member 119, an increase in the temperature decreases separation distances among the first ball bearing 133, the circular member 119, and the roller 134. In this case, when the roller 134 is sandwiched between the first ball bearing 133 and the circular member 119 and diameter difference $\Delta B1$ decreases to hinder the rotation of the roller 134, the deceleration mechanism 108 is extremely unlikely to operate normally.

According to the present embodiment, limit value $\Delta Bz1$ represents the smallest value possible for diameter difference $\Delta B1$ only to the extent that too small diameter difference $\Delta B1$ does not hamper the rotation of the roller 134. Limit temperature Tz1 represents the temperature that decreases diameter difference $\Delta B1$ to limit value $\Delta Bz1$. The valve timing adjusting device 100 uses selected steel materials and other materials so that the normal operation of the internal combustion engine causes limit temperature Tz1 to be higher than the temperature (such as 130° C.) the circular member 119, the first ball bearing 133, and the roller 134 can reach. Namely, steel materials and other materials are selected for the circular member 119, the first ball bearing 133, the roller 134, and the retainer 141 so that limit temperature Tz1 is higher than the temperature the lubricating oil for the valve timing adjusting device 100 can reach.

According to the present embodiment, reference temperature Tq represents the temperature lower than limit temperature Tz1. Reference diameter Bbq represents outside diameter Bb of the first ball bearing 133 with reference to reference temperature Tq. Reference diameter Bcq represents pitch circle inner diameter Bc of the circular member 119 with reference to reference temperature Tq. Reference diameter Bdq represents retaining diameter Bd of the retainer 141. Reference diameter Baq represents outside diameter Ba of the roller 134. In this case, when linear expansion coefficient βa for the roller 134, linear expansion coefficient βb for the outer ring 133*b* of the first ball bearing 133, and linear expansion coefficient βc for the circular member 119 are used, the relationship Baq x βa+Bbq×βb>Bcq×βc . . . (3) is established. The relationship denotes that the sum of products, namely, the product of reference diameter Baq and linear expansion coefficient βa and the product of reference diameter Bbq and linear expansion coefficient βb, is larger than the product of reference diameter Bcq and linear expansion coefficient βc. Reference temperature Tq is assumed to be the ordinary temperature such as 20° C.

Figure 19:
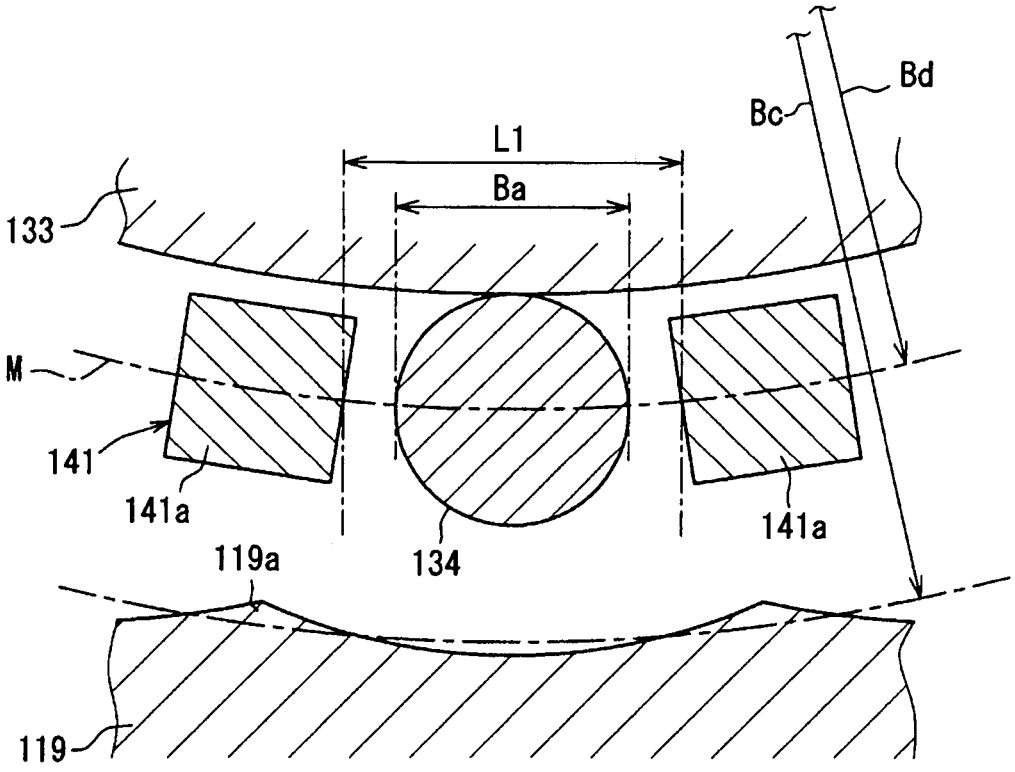
FIG. 19 is an explanatory diagram illustrating sizes of a protruding portion and a roller adjacent to each other on a retainer.

As illustrated in FIG. 19, retaining distance L1 represents a separation distance between adjacent protruding portions 141*a* of the retainers 141 and is larger than outside diameter Ba of the roller 134. Retaining distance L1 represents a direct distance between points that exist on mutually opposing faces of the adjacent protruding portion 141*a* and intersect with the virtual circle M. In this example, size difference ΔB2 represents a difference between retaining distance L1 and the outside diameter Ba of the roller 134 (see FIGS. 22 and 23).

Figure 20:
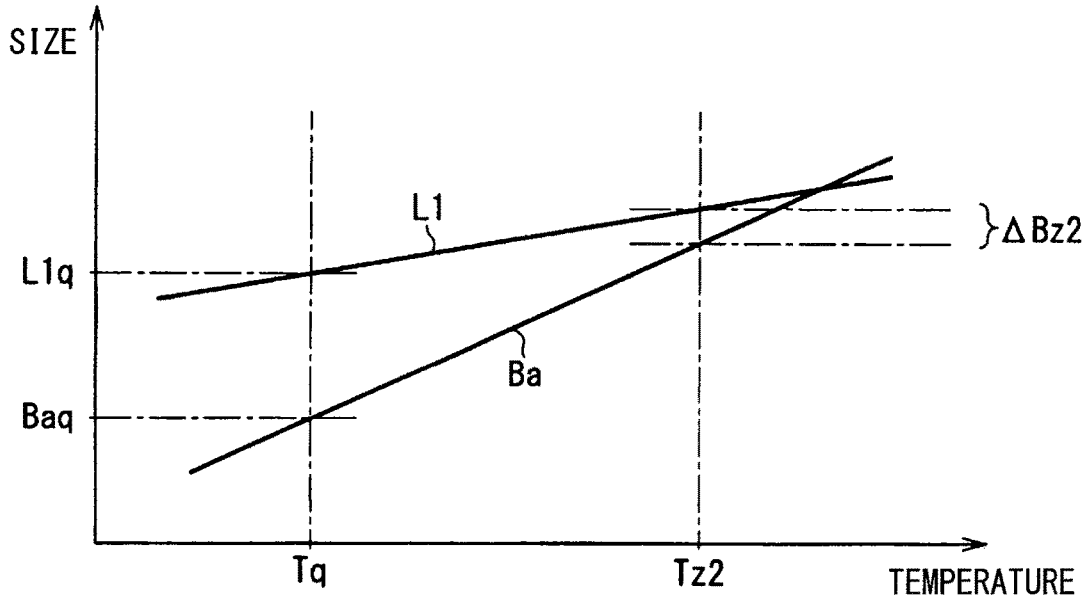
FIG. 20 is an explanatory diagram illustrating increase rates corresponding to sizes of a protruding portion and a roller adjacent to each other on a retainer.
Figure 21:
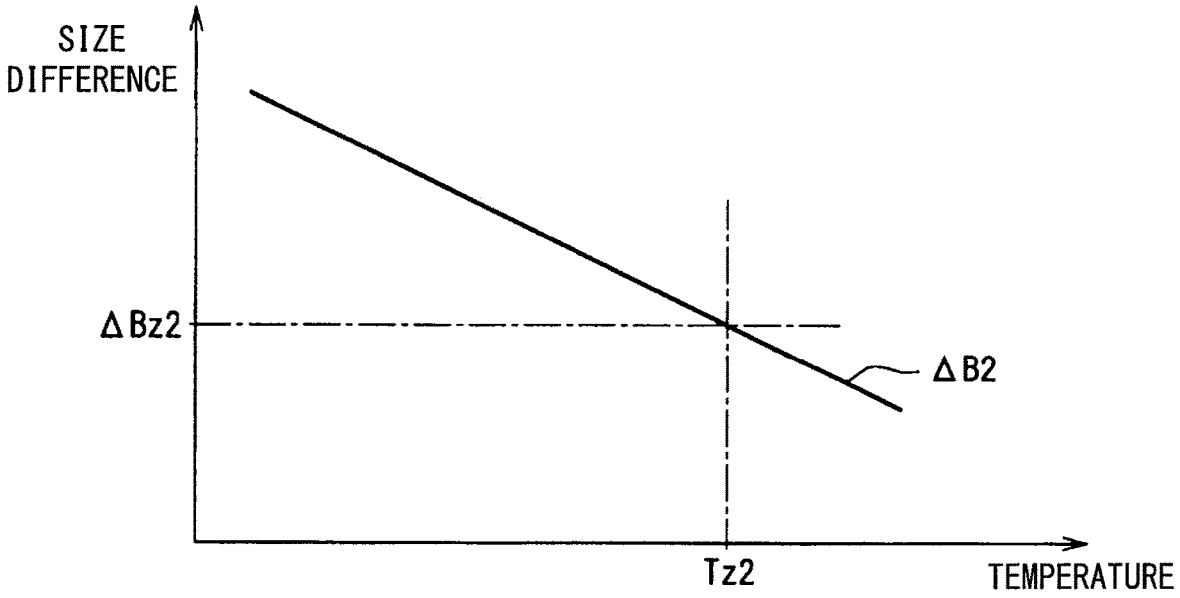
FIG. 21 is an explanatory diagram illustrating modes of change in a size difference as a difference between a roller diameter and a retaining distance between adjacent protruding portions.

As illustrated in FIGS. 20 and 21, linear expansion coefficient βa for the roller 134 and linear expansion coefficient βd for the retainer 141 are configured so that size difference ΔB2 decreases in accordance with an increase in the temperature at the roller 134 and the retainer 141. The increase rate for outside diameter Ba of the roller 134 is higher than the increase rate for retaining distance L1 of the retainer 141. Size difference ΔB2 decreases as the temperature rises. The configuration enables to inhibit a situation where the roller 134 excessively expands thermally compared to the retainer 141 and the roller 134 is sandwiched between adjacent protruding portions 134*a* to hamper the rotation of the roller 134.

According to the present embodiment, limit value ΔBz2 represents the smallest value possible for size difference ΔB2 only to the extent that the rotation of the roller 134 is not hampered by being sandwiched between the adjacent protruding portions 141*a*. Limit temperature Tz2 represents the temperature that causes the value diameter difference ΔB2 to decrease down to limit value ΔBz2. The valve timing adjusting device 10 uses steel materials and other materials selected for the roller 134 and the retainer 141 so that limit temperature Tz2 is higher than the temperature (such as 130° C.) the roller 134 and the retainer 141 can reach.

Reference temperature Tq is lower than not only limit temperature Tz1 but also limit temperature Tz2. In terms of reference temperature Tq, reference diameter Baq represents outside diameter Ba of the roller 134. Reference distance L1*q* represents retaining distance L1 of the retainer 141. In this case, when linear expansion coefficient βa for the roller 134 and linear expansion coefficient βd for the retainer 141 are used, the relationship Baq×βa>L1*q*×βd . . . (4) is established. The relationship denotes that the product of reference diameter Baq and linear expansion coefficient βa is larger than the product of reference distance L1*q* and linear expansion coefficient βd Reference temperature Tq causes the width of the protruding portion 141*a* in the radial direction of the retainer 141 to be smaller than outside diameter Ba of the roller 134. In this case, the roller 134 comes in complete contact with the first ball bearing 133 and the circular member 119. The configuration enables to inhibit a situation where the roller 134 does not come in contact with the first ball bearing 133 or the circular member 119 and the deceleration mechanism 108 does not operate properly.

As above, the valve timing adjusting device 100 according to the present embodiment allows linear expansion coefficient βb for the outer ring 133*b* of the first ball bearing 133 to be larger than linear expansion coefficient βc for the circular member 119. Diameter difference ΔB1 decreases as the temperature rises in the valve timing adjusting device 100. Namely, estimated distance CL3 decreases. Estimated distance CL3 enables the roller 134 to move in the radial direction of the first ball bearing 133 between the first ball bearing 133 and the circular member 119. Estimated distance CL3 corresponds to a separation distance ensured between the internal tooth 119*a* and the roller 134 engaged with each other before the first ball bearing 133 and the circular member 119 are virtually moved in the radial direction so as to separate the internal tooth 119*a* of the circular member 119 and the roller 134 engaged with each other.

Figure 22:
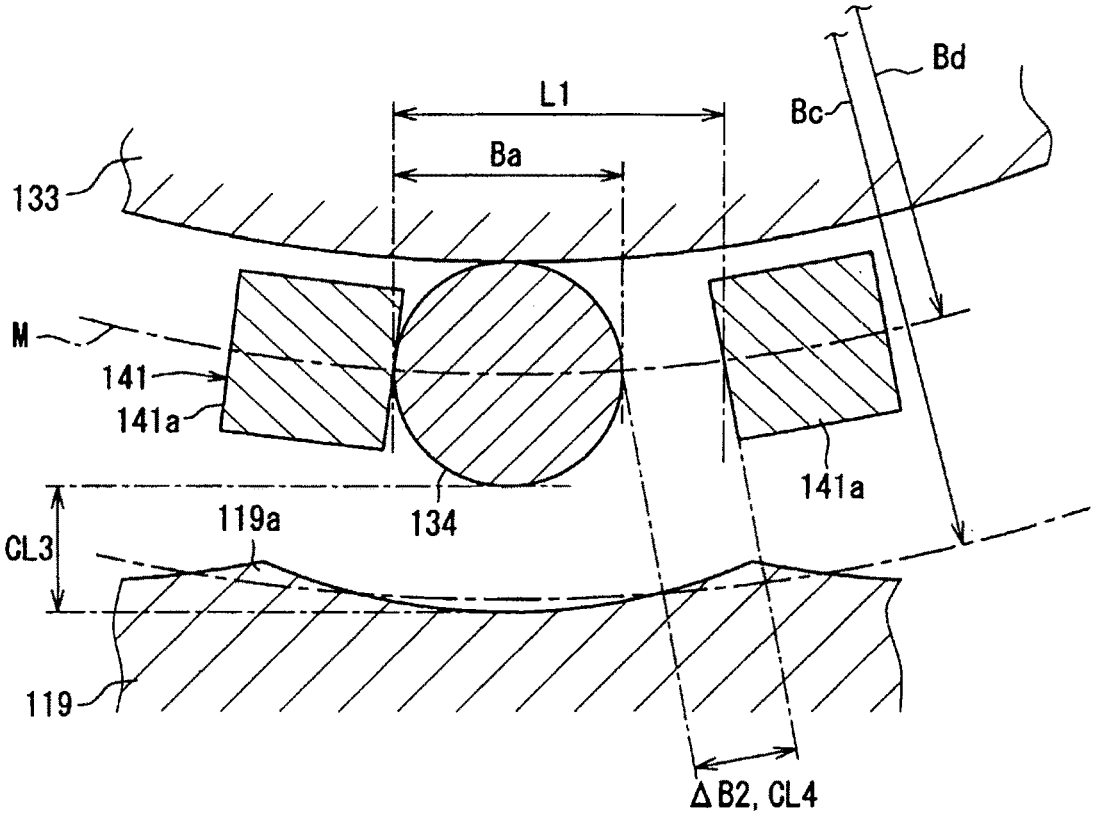
FIG. 22 is an explanatory diagram illustrating the positional relationship among the circular member, the first ball bearing, the roller, and the retainer before the temperature rises.
Figure 23:
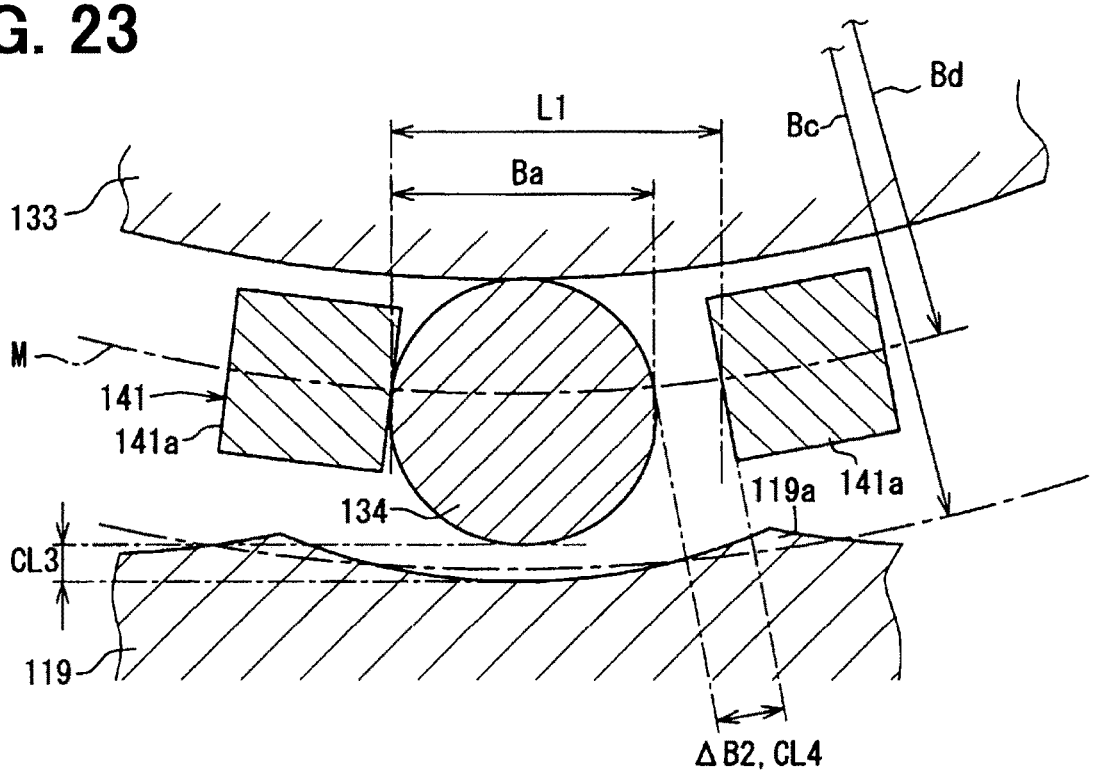
FIG. 23 is an explanatory diagram illustrating the positional relationship among the circular member, the first ball bearing, the roller, and the retainer after the temperature rises.

With reference to FIGS. 22 and 23, the description below explains estimated distance CL3. The state before the virtual movement concerns the internal tooth 119*a* and the roller 134 in contact with the bottom of the internal tooth 119*a*. FIGS. 22 and 23 after the virtual movement assume estimated distance CL3 to be the shortest distance between the bottom of the internal tooth 119*a* and the roller 134. FIG. 22 illustrates estimated distance CL3 when the temperature is sufficiently decreased in lubricating oil for the valve timing adjusting device 100 during the cold start of the internal combustion engine. In this case, the viscosity of the lubricating oil is large. The lubricating oil tends to regulate the relative movement among the first ball bearing 133, the roller 134, and the circular member 119. Even when estimated distance CL3 is large to some degree, it is hard to increase the momentum when a collision occurs among the first ball bearing 133, the circular member 119, and the roller 134.

FIG. 23 illustrates estimated distance CL3 when the temperature is increased in the lubricating oil for the valve timing adjusting device 100 during operation of the internal combustion engine. In this case, estimated distance CL3 is smaller than estimated distance CL3 at the cold start because linear expansion coefficient βb for the outer ring 133*b* of the first ball bearing 133 is larger than linear expansion coefficient βc for the circular member 119. Even when the viscosity of the lubricating oil decreases as the temperature rises, it is hard to increase the momentum when a collision occurs between the roller 134 and the first ball bearing 133 or the circular member 119 because a movement distance between the same is small. The configuration enables to reduce a rattling sound resulting from a collision between the roller 134 and the first ball bearing 133 or the circular member 119 regardless of whether the temperature of the valve timing adjusting device 100 is low or high.

The valve timing adjusting device 100 according to the present embodiment allows linear expansion coefficient βb for the first ball bearing 133 as an inner rotor to be larger than linear expansion coefficient βc for the circular member 119. As the temperature rises, the configuration enables to decrease diameter difference ΔB1 as a difference between outside diameter Bb for the first ball bearing 133 and pitch circle inner diameter Bc for the circular member 119. The configuration enables to decrease estimated distance CL3 that enables the roller 134 to move in the radial direction of the first ball bearing 133 between the first ball bearing 133 and the circular member 119 in a condition where the temperature rises. The configuration enables to inhibit the momentum when a collision occurs between the roller 134 and the first ball bearing 133 or between the roller 134 and the circular member 119. The configuration enables to inhibit the occurrence of a rattling sound when the valve timing adjusting device 100 is driven.

According to the present embodiment, the increase rate for outside diameter Bb corresponding to the temperature rise at the first ball bearing 133 is higher than the increase rate for pitch circle inner diameter Bc corresponding to the temperature rise at the circular member 119. The first ball bearing 133 and the circular member 119 are configured to take account of outside diameter Bb and pitch circle inner diameter Bc in addition to linear expansion coefficients βb and βc. Therefore, the configuration enables to decrease estimated distance CL3 as the temperature rises.

According to the present embodiment, the increase rate for outside diameter Ba of the roller 134 is higher than the increase rate for diameter difference ΔB1 as a difference between pitch circle inner diameter Bc for the circular member 119 and outside diameter Bb of the first ball bearing 133. In addition, the above-described relationship (3) is established. The present embodiment takes account of the movement mode of the roller 134 in the distant space between the first ball bearing 133 and the circular member 119 including the expansion extent of the roller 134. The configuration enables to more reliably embody a configuration that decreases estimated distance CL3 as the temperature rises.

The present embodiment can satisfy the above-described relationship (3) by providing a proper ratio between linear expansion coefficient βb for the first ball bearing 133 and linear expansion coefficient βc for the circular member 119 without changing conventional sizes of the first ball bearing 133 or the circular member 119. There is no need to change sizes at the design stage of the valve timing adjusting device 100. The configuration enables to inhibit an increase in the costs incurred by the design change.

The present embodiment allows linear expansion coefficient βa for the roller 134 to be larger than linear expansion coefficient βd for the retainer 141. Size difference ΔB2 decreases as the temperature rises in the valve timing adjusting device 100. Size difference ΔB2 is comparable to estimated distance CL4 that enables the roller 134 to move in the circumferential direction of the virtual circle M between the adjacent protruding portions 141*a* of the retainers 141.

As illustrated in FIG. 22, the viscosity of the lubricating oil is large when the heat of the lubricating oil is sufficiently dissipated. The lubricating oil tends to regulate the relative movement between the protruding portion 141*a* of the retainer 141 and the roller 134. Even when size difference ΔB2 is large to some degree, it is hard to increase the momentum when a collision occurs between the protruding portion 141*a* and the roller 134.

When the lubricating oil reaches a high temperature as illustrated in FIG. 23, size difference ΔB2 is smaller than size difference ΔB2 at the cold start because linear expansion coefficient βa for the roller 134 is larger than linear expansion coefficient βd for the retainer 141. Even when the viscosity of the lubricating oil decreases as the temperature rises, it is hard to increase the momentum when a collision occurs between the roller 134 and the protruding portion 141*a* because a movement distance between the same is small. The configuration enables to reduce a rattling sound resulting from a collision between the roller 134 and the protruding portion 141*a* of the retainer 141 regardless of whether the temperature of the valve timing adjusting device 100 is low or high.

According to the present embodiment, the increase rate for outside diameter Ba corresponding to the temperature rise at the roller 134 is higher than the increase rate for retaining distance L1 corresponding to the temperature rise at the retainer 141. The above-described relationship (4) is established. The roller 134 and the retainer 141 are configured to take account of outside diameter Ba and retaining distance L1 for the adjacent protruding portions 141*a* in addition to linear expansion coefficients βa and βd. The configuration enables to decrease size difference ΔB2 as the temperature rises.

The present embodiment can satisfy the above-described relationship (4) by providing a proper ratio between linear expansion coefficient βa for the roller 134 and linear expansion coefficient βd for the retainer 141 without changing conventional sizes of the roller 134 or the retainer 141. There is no need to change sizes at the design stage of the valve timing adjusting device 100. The configuration enables to inhibit an increase in the costs incurred by the design change.

C. Third Embodiment

Figure 24:
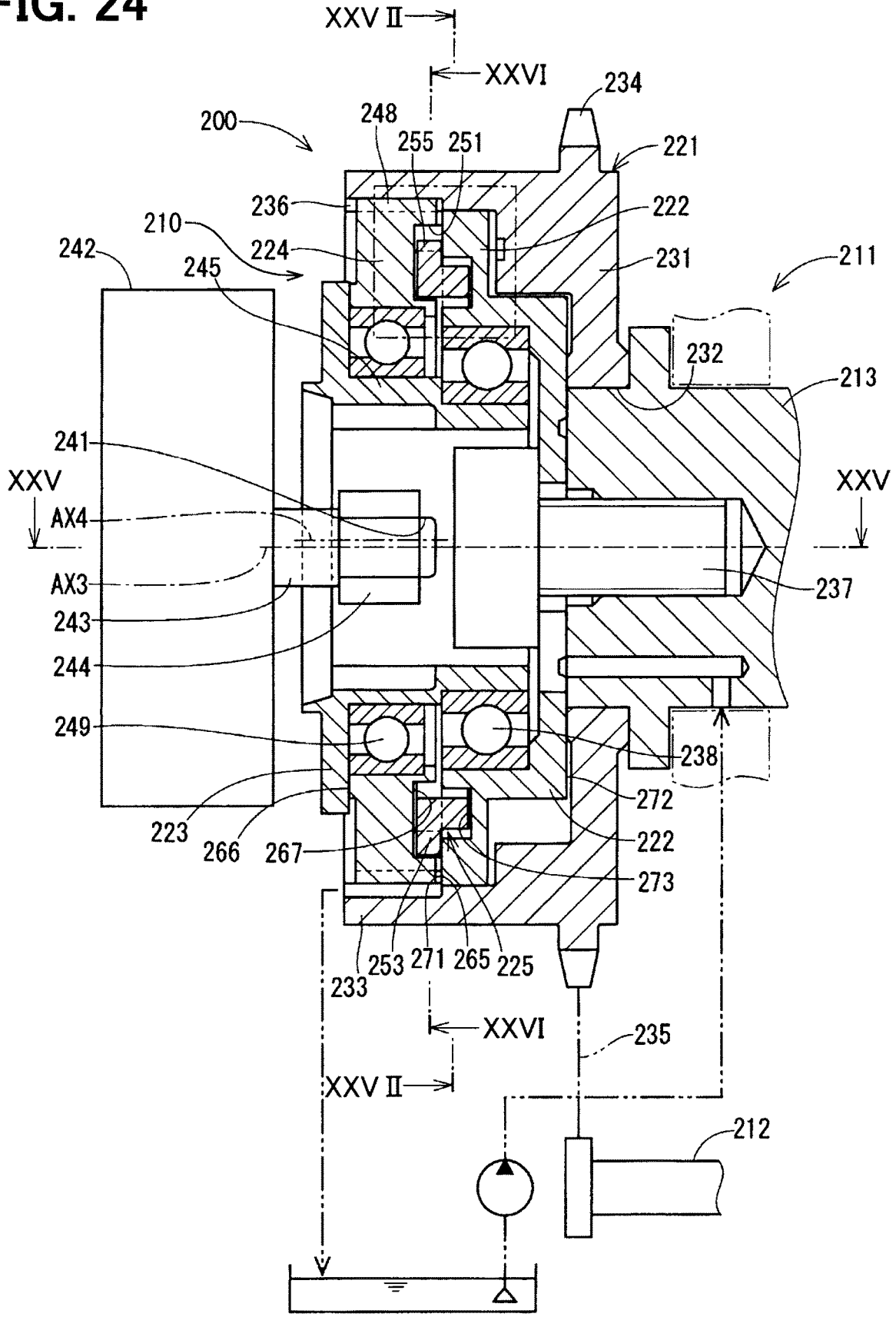
FIG. 24 is a cross-sectional view illustrating a schematic configuration of a valve timing adjusting device according to a third embodiment.

A valve timing adjusting device 200 as illustrated in FIG. 24 according to the third embodiment differs from the valve timing adjusting device 10 according to the first embodiment in that the valve timing adjusting device 200 includes a deceleration mechanism 210 comparable to a K-H-V planetary gear mechanism instead of the 2K-H planetary gear mechanism. The deceleration mechanism 27 included in the valve timing adjusting device 10 according to the first embodiment includes two pairs of gear portions comprised of the internal gear portions 37 and 38 and the external gear portions 50 and 51. The deceleration mechanism 210 included in the valve timing adjusting device 200 according to the third embodiment includes a pair of gear portions.

Similarly to the valve timing adjusting device 10 according to the first embodiment, the valve timing adjusting device 200 according to the third embodiment is provided for the power transmission path from a crankshaft 212 to a camshaft 213 of an internal combustion engine 211. The valve timing adjusting device 200 adjusts the valve timing of an intake valve as an unillustrated valve opened and closed by the camshaft 213 to which the engine torque is transmitted from the crankshaft 212.

As illustrated in FIGS. 24 through 31, the valve timing adjusting device 200 includes a driving rotor 221, a driven rotor 222, and the deceleration mechanism 210. The driving rotor 221 rotates about a rotational shaft center AX3 in conjunction with the crankshaft 212. The driving rotor 221 is shaped into a bottomed cylinder. The camshaft 213 is inserted into a shaft insertion hole 232 at a bottom portion 231. The rotational shaft center AX3 approximately corresponds to the shaft center of the camshaft 213. A sprocket 234 is provided integrally with the outside wall of a cylinder portion 233 of the driving rotor 221. The sprocket 234 is coupled to the crankshaft 212 via a transmission member 235 such as a chain. An internal gear portion is provided at the opening side of the inside wall of the cylinder portion 233. The internal gear portion includes an internal tooth 236 formed inward in the radial direction.

The driven rotor 222 is provided coaxially with the driving rotor 221 and rotates about the rotational shaft center AX3 in conjunction with the camshaft 213. The driven rotor 222 is shaped into a stepped circular plate and is fastened to the camshaft 213 at the center by using a fastening member 237.

The deceleration mechanism 210 includes an input rotor 223, a planetary rotor 224, and an eccentricity absorbing portion 225. The input rotor 223 is approximately shaped into a cylinder as an external view and is provided coaxially with the driving rotor 221. A bearing 238 is provided between the input rotor 223 and a stepped portion of the driven rotor 222. A fitting groove 241 is formed in the inside wall of the input rotor 223. The input rotor 223 is coupled to an electric motor 242 by fitting a connection portion 244 of a rotational shaft 243 of the electric motor 242 into the fitting groove 241. The input rotor 223 rotates about the rotational shaft center AX3. The input rotor 223 includes an eccentricity portion 245 that is eccentric with reference to the rotational shaft center AX3. A recessed portion 246 opened outward in the radial direction is formed at the eccentric side of the eccentricity portion 245. The recessed portion 246 accommodates a resilient member 247. The shaft center of the eccentricity portion 245 is hereinafter referred to as an eccentric shaft center AX4. The eccentric shaft center AX4 and the rotational shaft center AX3 are parallel to each other.

The planetary rotor 224 includes an external tooth 248 that is provided coaxially with the eccentricity portion 245 and engages with the internal tooth 236. The external tooth 248 is formed outward in the radial direction. A bearing 249 is provided between the eccentricity portion 245 and the planetary rotor 224. When the input rotor 223 rotates relative to the driving rotor 221, the planetary rotor 224 revolves about the rotational shaft center AX3, concurrently turns or rotates about the eccentric shaft center AX4, and thereby changes a relative rotational phase between the driving rotor 221 and the driven rotor 222.

The eccentricity absorbing portion 225 transmits the power between the planetary rotor 224 and the driven rotor 222 while absorbing the eccentricity power between the same. According to the present embodiment, the eccentricity absorbing portion 225 represents the Oldham mechanism including a first engaging groove 251, a second engaging groove 252, and a joint portion 253. The first engaging groove 251 is provided integrally with the planetary rotor 224. The second engaging groove 252 is provided integrally with the driven rotor 222. The joint portion 253 transmits the power between the first engaging groove 251 and the second engaging groove 252 while rocking in the radial direction of the first engaging groove 251 and the second engaging groove 252.

Figure 31:
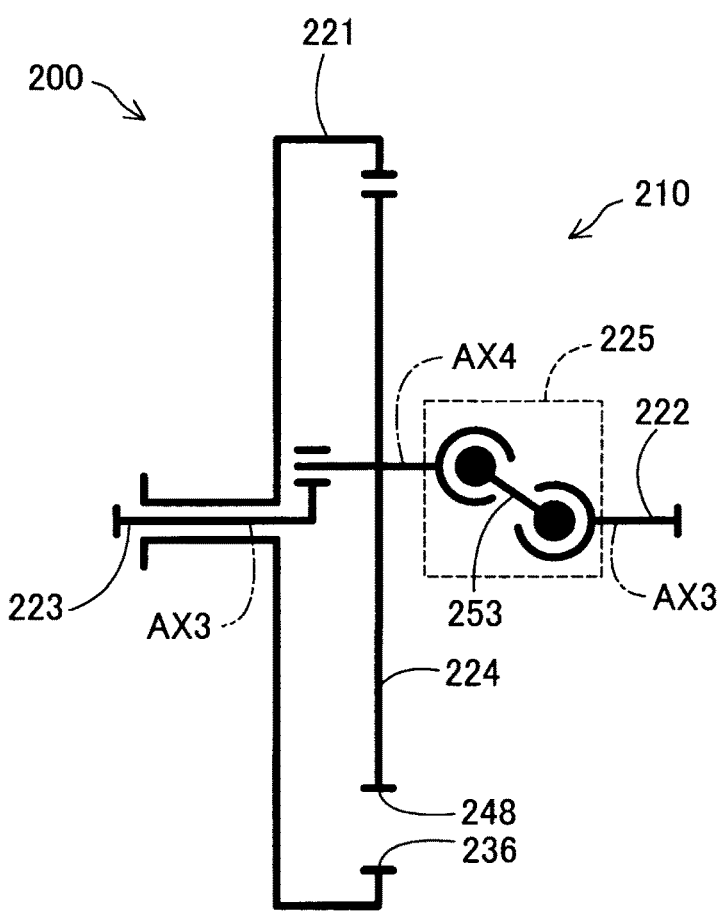
FIG. 31 is a skeleton diagram schematically illustrating a configuration of a valve timing adjusting device according to the third embodiment.

As illustrated in FIG. 31, the joint portion 253 transmits the power between the rotational shaft center AX3 and the eccentric shaft center AX4. According to the present embodiment, the joint portion 253 couples the planetary rotor 224 with the driven rotor 222.

As illustrated in FIGS. 24 through 28, the joint portion 253 includes a circular portion 254, a first protruding portion 255, and a second protruding portion 256. The first protruding portion 255 and the second protruding portion 256 protrude from the circular portion 254 to the outside in the radial direction. One side of the circular portion 254 in the across-the-width direction is referred to as a one-side portion 257. The other side of the circular portion 254 in the across-the-width direction is referred to as another-side portion 258. The first protruding portion 255 is provided for the one-side portion 257 at two locations along a first sliding direction orthogonal to the axial direction. The second protruding portion 256 is provided for the other-side portion 258 at two locations along a second sliding direction intersecting with the axial direction and the first sliding direction.

Figure 26:
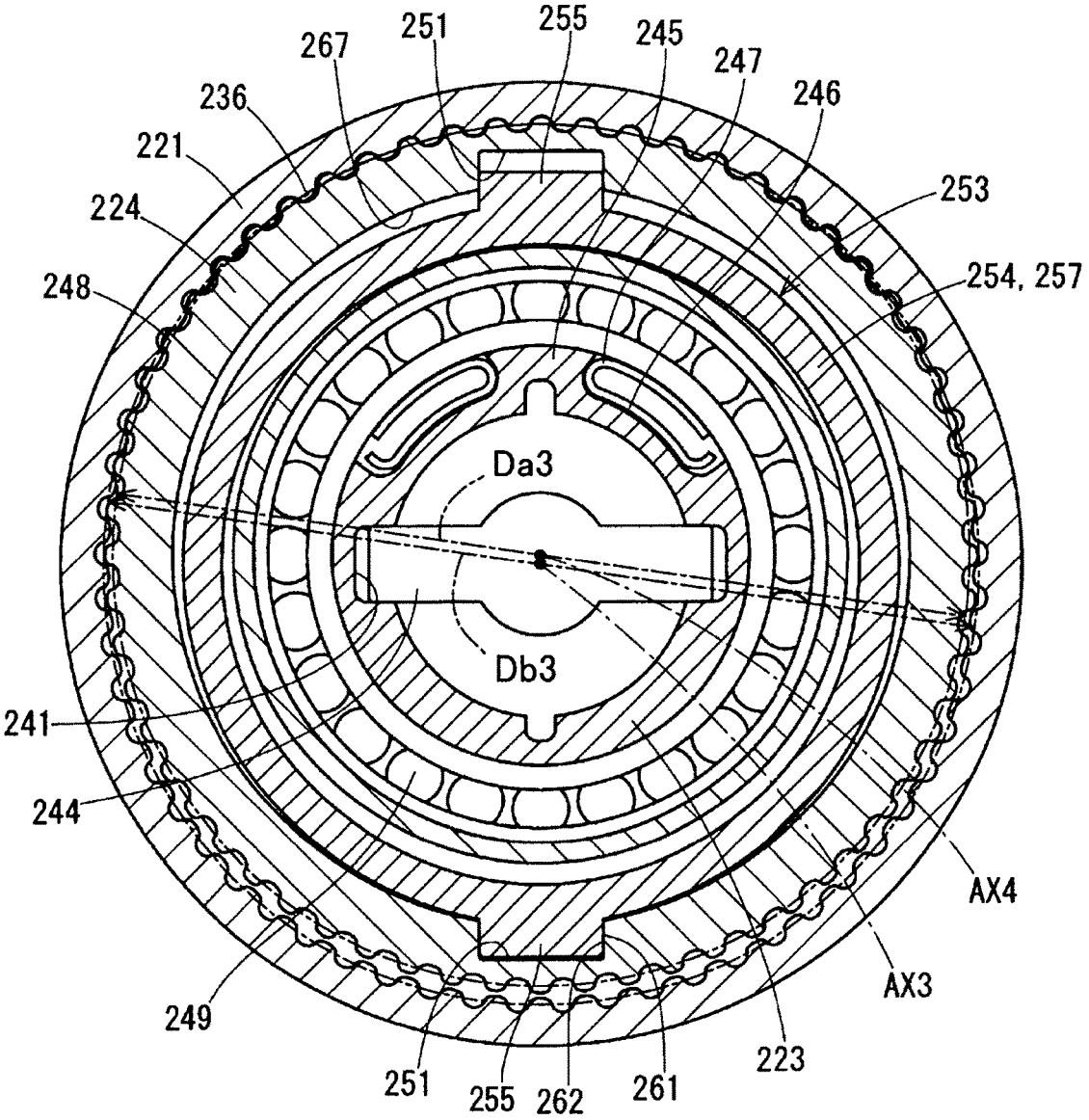
FIG. 26 is a cross-sectional view taken along the line XXVI-XXVI of FIG. 24.

As illustrated in FIG. 26, the first protruding portion 255 engages with the first engaging groove 251. The first engaging groove 251 includes a first groove engaging face 262 at a location where the first engaging groove 251 faces the first protrusion engaging face 261 of the first protruding portion 255 in the circumferential direction. The first protrusion engaging face 261 comes into contact with the first groove engaging face 262 in the circumferential direction and is slidable in the first sliding direction. The first protruding portion 255 engages with the first engaging groove 251 so as to be slidable.

Figure 27:
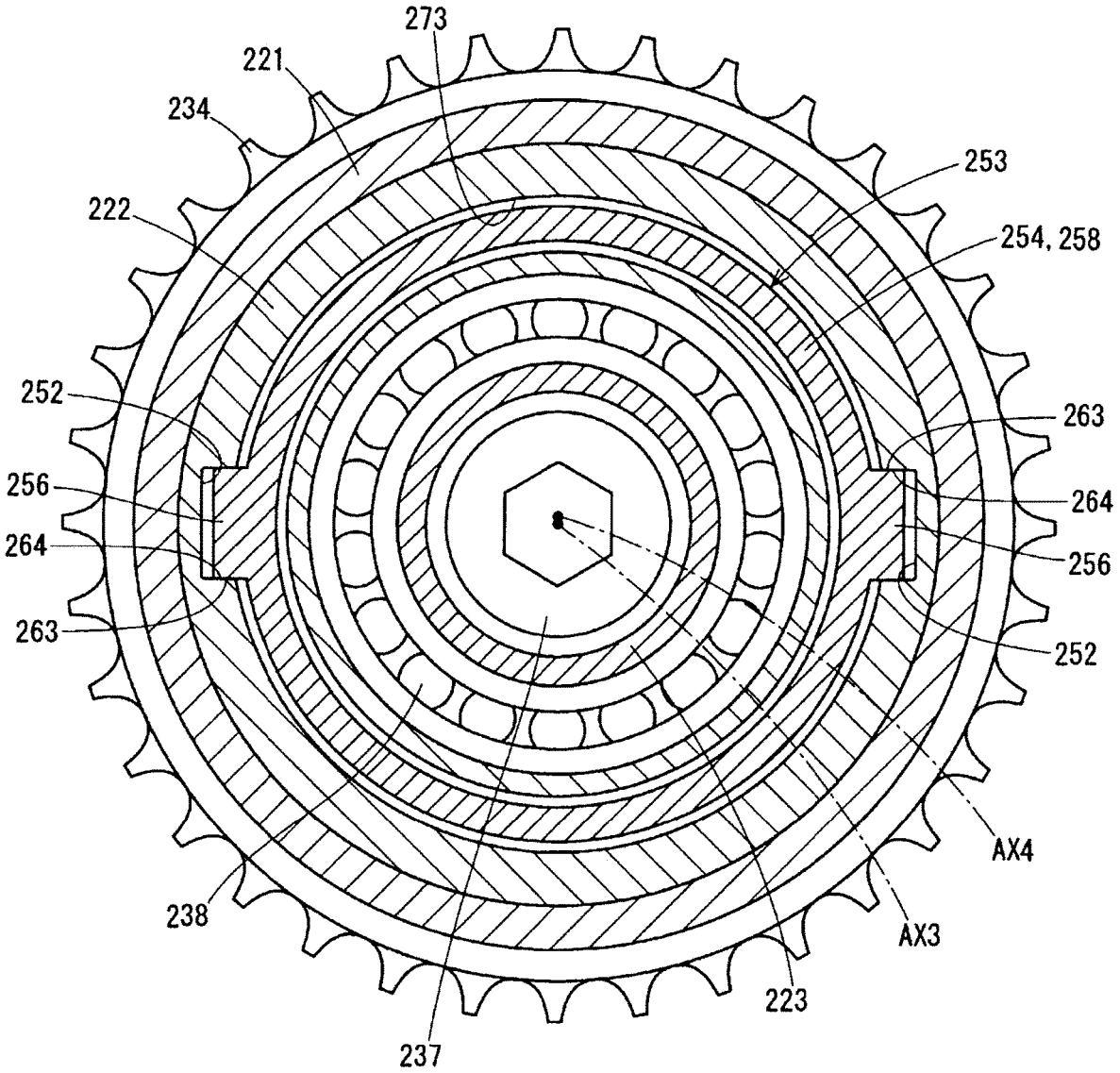
FIG. 27 is a cross-sectional view taken along the line XXVII-XXVII of FIG. 24.
Figure 28:
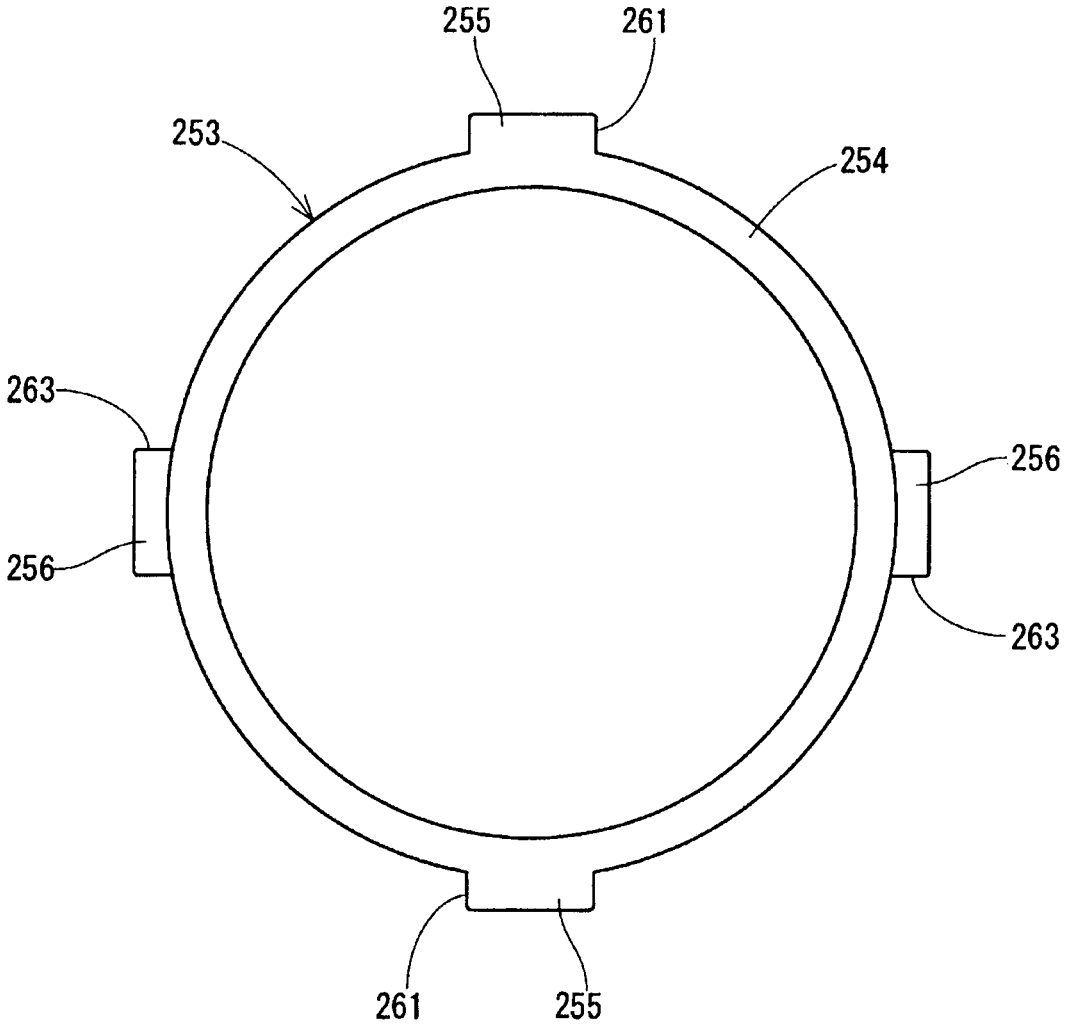
FIG. 28 is a front view of a joint portion viewed from an electric motor.

As illustrated in FIG. 27, the second protruding portion 256 engages with the second engaging groove 252. The second engaging groove 252 includes a second groove engaging face 264 at a location where the second engaging groove 252 faces the second protrusion engaging face 263 of the second protruding portion 256 in the circumferential direction. The second protrusion engaging face 263 comes in contact with the second groove engaging face 264 in the circumferential direction and is slidable in the second sliding direction. The second protruding portion 256 engages with the second engaging groove 252 so as to be slidable.

Figure 29:
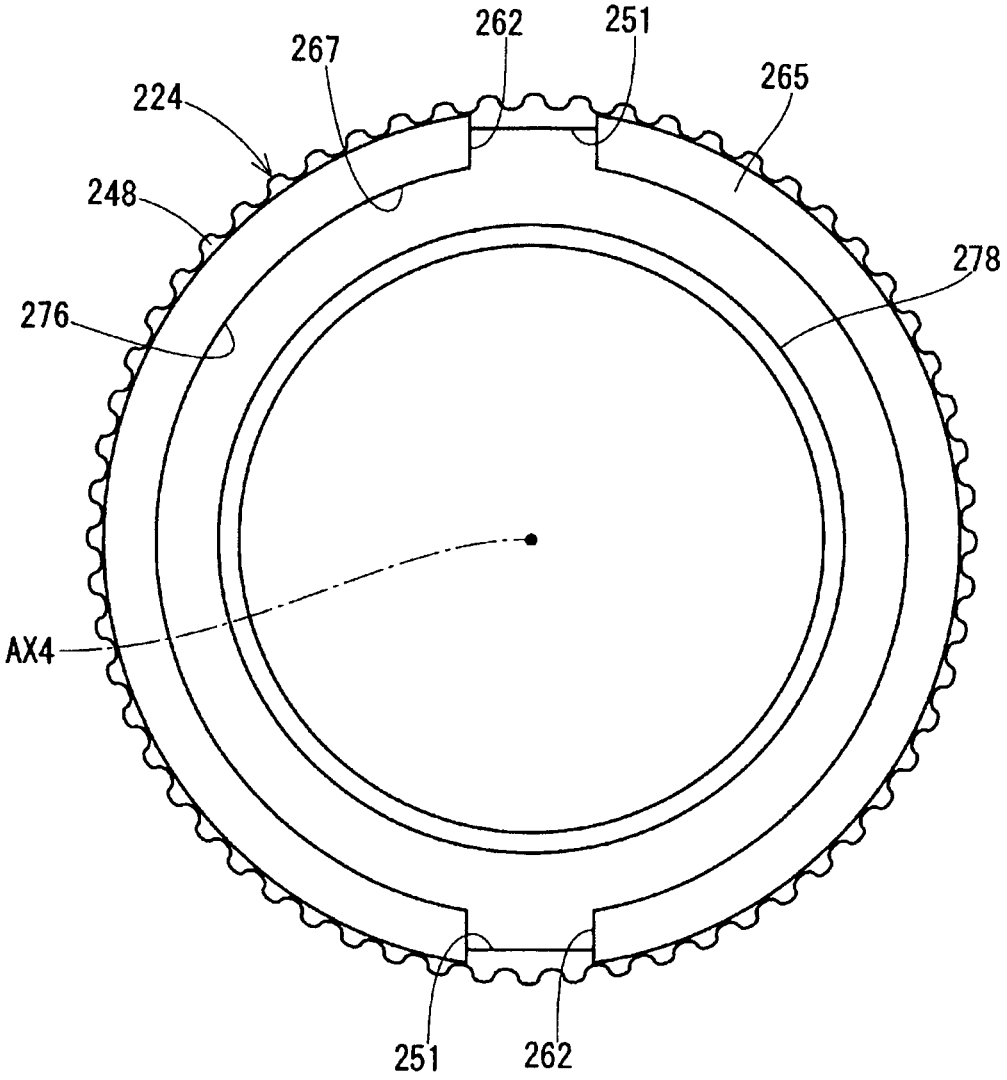
FIG. 29 is a front view of a planetary rotor viewed from a side opposite the electric motor.

As illustrated in FIGS. 24, 26, and 29, the planetary rotor 224 includes an annular first accommodation recessed portion 267 that is recessed toward another end face 266 from a one end face 265 at the joint portion 253 and accommodates the one-side portion 257 of the circular portion 254 of the joint portion 253. The first engaging groove 251 is formed so as to extend outward from the first accommodation recessed portion 267 in the radial direction. The first engaging groove 251 does not reach a tooth surface of the external tooth 248. The first engaging groove 251 is formed so as to be recessed toward the other end face 266 from the one end face 265 at the joint portion 253 of the planetary rotor 224.

Figure 25:
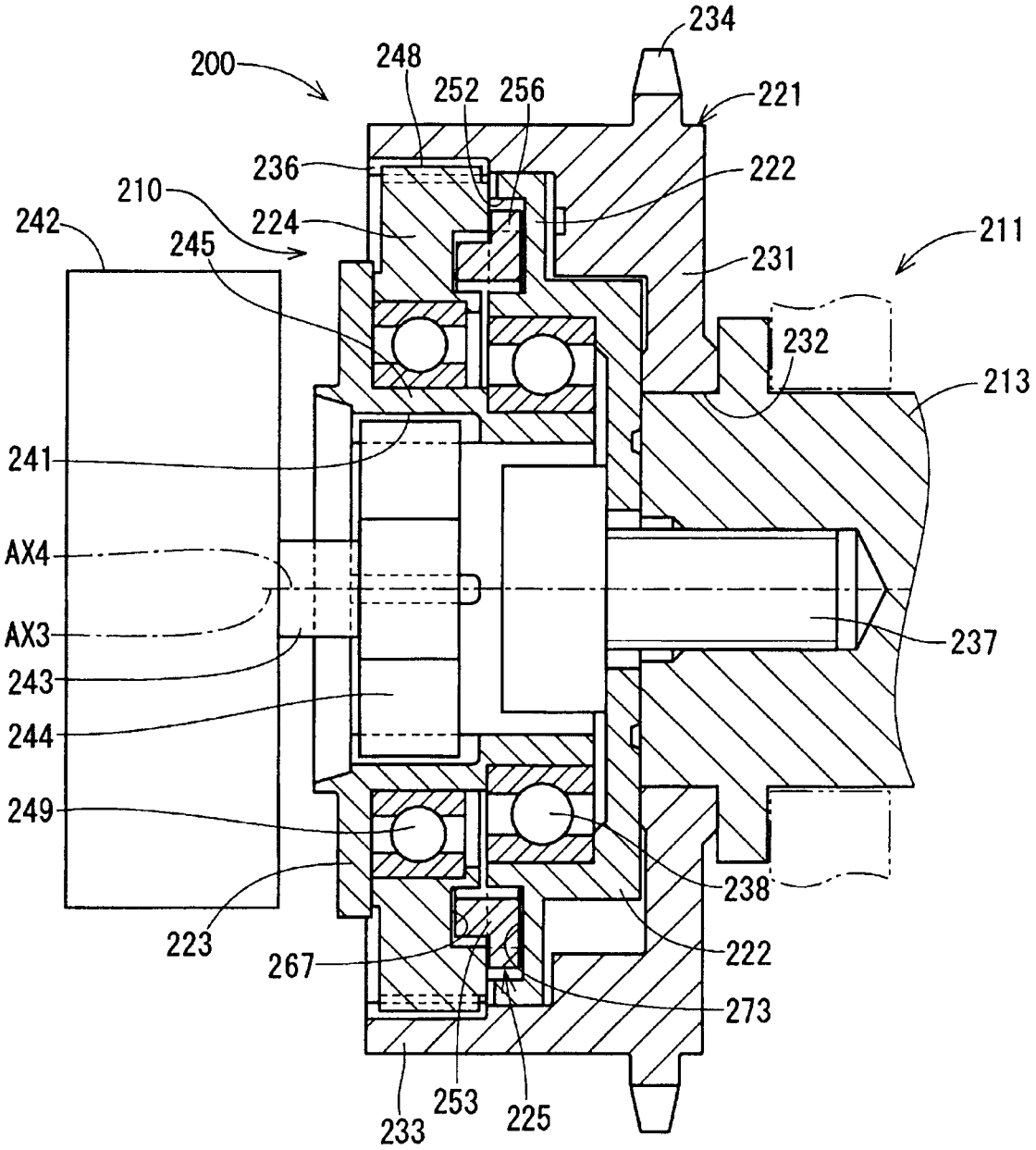
FIG. 25 is a cross-sectional view taken along the line XXV-XXV of FIG. 24.
Figure 30:
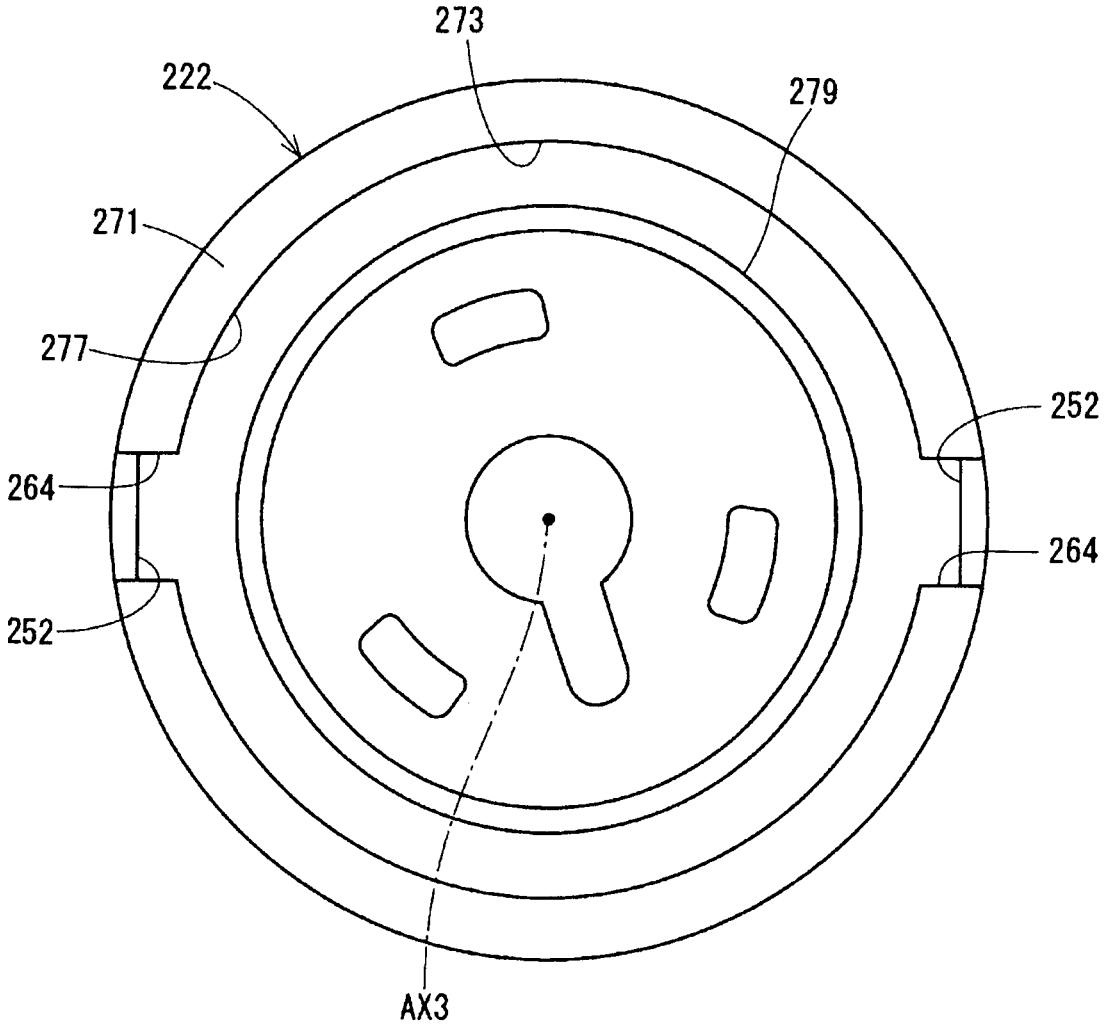
FIG. 30 is a front view of a driven rotor viewed from the electric motor.

As illustrated in FIGS. 25, 27, and 30, the driven rotor 222 includes an annular second accommodation recessed portion 273 that is recessed toward another end face 272 from a one end face 271 at the joint portion 253 and accommodates the other-side portion 258 of the circular portion 254 of the joint portion 253. The second engaging groove 252 is formed so as to extend outward from the second accommodation recessed portion 273 in the radial direction. The second engaging groove 252 is formed so as to be recessed toward the camshaft 213 from the one end face 271 at the joint portion 253 of the driven rotor 222.

According to the present embodiment, the planetary rotor 224 is formed of a steel material such as S45C. An internal gear portion is provided for the driving rotor 221 and is formed of a steel material such as SUS440C. Therefore, a linear expansion coefficient for the planetary rotor 224 is larger than a linear expansion coefficient for the internal gear portion provided for the driving rotor 221. As illustrated in FIG. 26 according to the present embodiment, pitch circle outer diameter Da3 as a pitch circle diameter of the planetary rotor 224 is smaller than pitch circle inner diameter Db3 as a pitch circle diameter of the internal gear portion provided for the driving rotor 221. With the increase in the temperature according to the present embodiment, the increase rate for the pitch circle outer diameter Da3 of the planetary rotor 224 is higher than the increase rate for pitch circle inner diameter Db3 of the internal gear portion provided for the driving rotor 221. According to the present embodiment, a product between the linear expansion coefficient for the planetary rotor 224 and pitch circle outer diameter Da3 of the planetary rotor 224 at a predetermined reference temperature is larger than a product between the linear expansion coefficient for the internal gear portion provided for the driving rotor 221 and pitch circle inner diameter Db3 of the internal gear portion provided for the driving rotor 221 at the reference temperature.

According to the present embodiment, the planetary rotor 224 corresponds to a subordinate concept of the external gear portion in the present disclosure.

As above, the valve timing adjusting device 200 according to the third embodiment provides effects similar to those of the valve timing adjusting device 10 according to the first embodiment. The linear expansion coefficient for the planetary rotor 224 is larger than the linear expansion coefficient for the internal gear portion provided for the driving rotor 221. As the temperature rises, the configuration enables to decrease a difference between pitch circle outer diameter Da3 for the planetary rotor 224 and pitch circle inner diameter Db3 of the internal gear portion provided for the driving rotor 221. When the temperature rises, the configuration enables to decrease a distance, which is to enable the planetary rotor 224 and the internal gear portion to relatively move to each other. The configuration enables to inhibit the momentum when a collision occurs between the planetary rotor 224 and the internal gear portion. The configuration enables to inhibit the occurrence of a rattling sound when the valve timing adjusting device 200 is driven.

D. Fourth Embodiment

Figure 32:
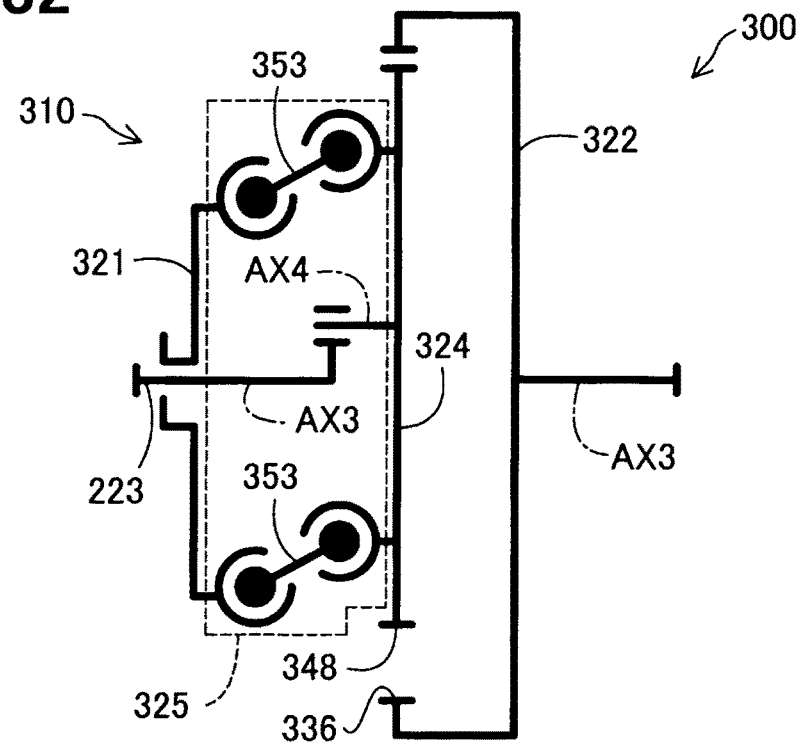
FIG. 32 is a skeleton diagram schematically illustrating a configuration of a valve timing adjusting device according to a fourth embodiment.

As illustrated in FIG. 32, a valve timing adjusting device 300 according to a fourth embodiment differs from the valve timing adjusting device 200 according to the third embodiment in that a deceleration mechanism 310 provides the internal gear portion for a driven rotor 322 instead of the driving rotor 221 and a joint portion 353 couples a planetary rotor 324 with a driving rotor 321 instead of the planetary rotor 224 with the driven rotor 222. The other configurations are equal to those of the third embodiment. The same configuration is designated by the same reference symbol and a detailed description is omitted.

The internal gear portion according to the fourth embodiment is provided for the driven rotor 322 and includes an internal tooth 336 formed inward in the radial direction. The internal tooth 336 engages with an external tooth 348 formed on the planetary rotor 324 as an external gear portion. The joint portion 353 configures part of an eccentricity absorbing portion 325 and couples the planetary rotor 324 with the driving rotor 321.

According to the present embodiment, a linear expansion coefficient for the planetary rotor 324 is larger than a linear expansion coefficient for the internal gear portion provided for the driven rotor 322. According to the present embodiment, a pitch circle outer diameter as a pitch circle diameter of the planetary rotor 324 is smaller than a pitch circle inner diameter as a pitch circle diameter of the internal gear portion provided for the driven rotor 322. With the increase in the temperature according to the present embodiment, an increase rate for the pitch circle outer diameter of the planetary rotor 324 is higher than an increase rate for the pitch circle inner diameter of the internal gear portion provided for the driven rotor 322. According to the present embodiment, a product between the linear expansion coefficient for the planetary rotor 324 and the pitch circle outer diameter of the planetary rotor 324 at a predetermined reference temperature is larger than a product between the linear expansion coefficient for the internal gear portion provided for the driven rotor 322 and the pitch circle inner diameter of the internal gear portion provided for the driven rotor 322 at the reference temperature.

As above, the valve timing adjusting device according to the fourth embodiment provides effects similar to those of the valve timing adjusting device 200 according to the third embodiment.

E. Fifth Embodiment

Figure 33:
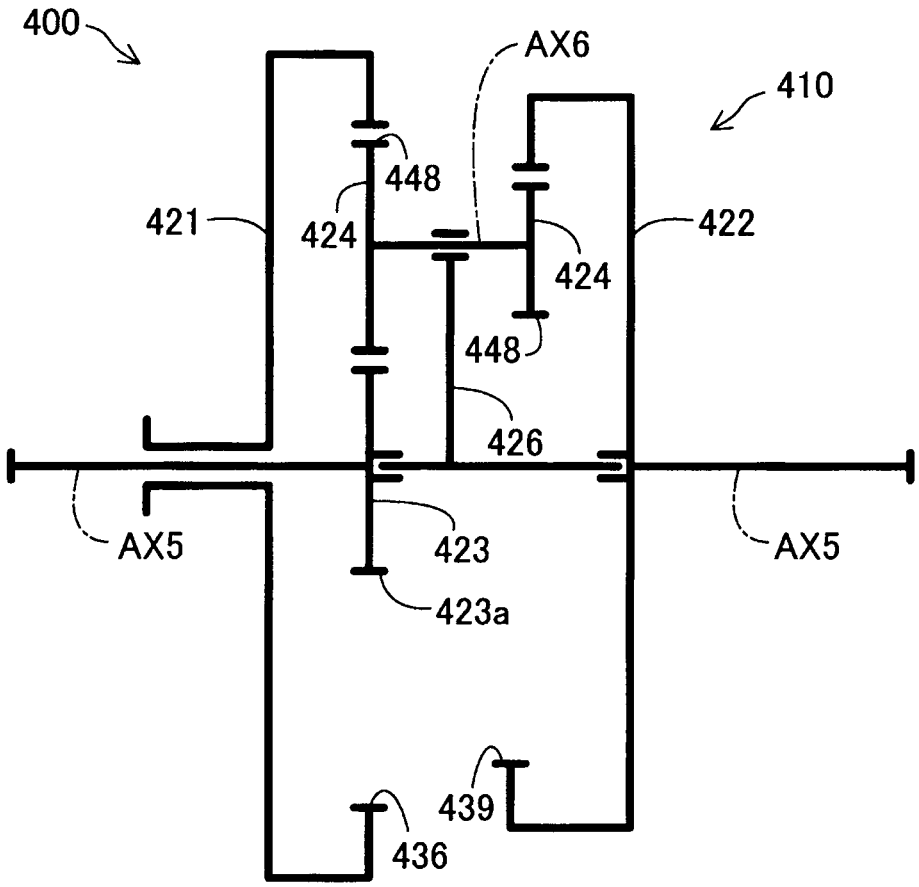
FIG. 33 is a skeleton diagram schematically illustrating a configuration of a valve timing adjusting device according to a fifth embodiment.

As illustrated in FIG. 33, a valve timing adjusting device 400 according to a fifth embodiment differs from the valve timing adjusting device 200 according to the third embodiment in that the valve timing adjusting device 400 includes a deceleration mechanism 410 comparable to a 3K planetary gear mechanism instead of the K-H-V planetary gear mechanism. The deceleration mechanism 410 according to the fifth embodiment includes a plurality of pairs of gear portions and does not include the Oldham mechanism as the eccentricity absorbing portion 225 including the joint portion 253. The other configurations are equal to those of the valve timing adjusting device 200 according to the third embodiment. The same configuration is designated by the same reference symbol and a detailed description is omitted.

The valve timing adjusting device 400 according to the fifth embodiment includes a driving rotor 421, a driven rotor 422, and the deceleration mechanism 410. The driving rotor 421 rotates about a rotational shaft center AX5 in conjunction with an unillustrated crankshaft. The driving rotor 421 is provided with a driving internal gear portion. The driving internal gear portion includes a driving internal tooth 436 formed inward in the radial direction. The driven rotor 422 is provided coaxially with the driving rotor 421 and rotates about the rotational shaft center AX5 in conjunction with the unillustrated camshaft. The driven rotor 422 is provided with a driven internal gear portion. The driven internal gear portion includes a driven internal tooth 439 formed inward in the radial direction. According to the present embodiment, a pitch circle inner diameter as a pitch circle diameter of the driven internal gear portion is smaller than a pitch circle inner diameter as a pitch circle diameter of the driving internal gear portion.

The deceleration mechanism 410 includes a sun gear 423, three planetary rotors 424, and a planetary carrier 426.

The sun gear 423 is coupled to an unillustrated electric motor. The sun gear 423 includes an external sun gear tooth 423*a* formed outward in the radial direction and rotates about the rotational shaft center AX5.

The three planetary rotors 424 as external gear portions are each placed outside the sun gear 423 in the radial direction. Each planetary rotor 424 includes an external tooth 448 formed outside the planetary rotor 424 in the radial direction and rotates about a rotational shaft center AX6 parallel to the rotational shaft center AX5. The external tooth 448 engages with the external sun gear tooth 423*a* formed on the sun gear 423. Each planetary rotor 424 revolves about the rotational shaft center AX5 and concurrently turns or rotates about the rotational shaft center AX6. The external tooth 448 of each planetary rotor 424 engages with the driving internal tooth 436 of a driving internal gear portion and the driven internal tooth 439 of a driven internal gear portion. The number of planetary rotor 424 is not limited to three but may be two or four as needed. The planetary carrier 426 is coupled to the center shaft of each planetary rotor 424 and retains the planetary rotor 424.

According to the present embodiment, a linear expansion coefficient for each planetary rotor 424 is larger than a linear expansion coefficient for the driving internal gear portion provided for the driving rotor 421. A linear expansion coefficient for each planetary rotor 424 is larger than a linear expansion coefficient for the driven internal gear portion provided for the driven rotor 422. According to the present embodiment, the pitch circle outer diameter as a pitch circle diameter of each planetary rotor 424 is smaller than the pitch circle inner diameter as a pitch circle diameter of the driving internal gear portion provided for the driving rotor 421 and the pitch circle inner diameter as a pitch circle diameter of the driven internal gear portion provided for the driven rotor 422.

With the increase in the temperature according to the present embodiment, an increase rate for the pitch circle outer diameter of each planetary rotor 424 is larger than an increase rate for the pitch circle inner diameter of the driving internal gear portion provided for the driving rotor 421 and an increase rate for the pitch circle inner diameter of the driven internal gear portion provided for the driven rotor 422. According to the present embodiment, a product between the linear expansion coefficient for each driven rotor 422 and the pitch circle outer diameter of each planetary rotor 424 at a predetermined reference temperature is larger than a product between the linear expansion coefficient for the driving internal gear portion provided for the driving rotor 421 and the pitch circle inner diameter of the driving internal gear portion provided for the driving rotor 421 at the reference temperature. A product between the linear expansion coefficient for each planetary rotor 424 and the pitch circle outer diameter of each planetary rotor 424 at the reference temperature is larger than a product between the linear expansion coefficient for the driven internal gear portion provided for the driven rotor 422 and the pitch circle inner diameter for the driven internal gear portion provided for the driven rotor 422.

According to the present embodiment, a linear expansion coefficient for the sun gear 423 is larger than a linear expansion coefficient for each planetary rotor 424. With the increase in the temperature according to the present embodiment, an increase rate for the pitch circle outer diameter of the sun gear 423 is larger than an increase rate for the pitch circle outer diameter of each planetary rotor 424. According to the present embodiment, a product between the linear expansion coefficient for the sun gear 423 and the pitch circle outer diameter of the sun gear 423 at a predetermined reference temperature is larger than a product between the linear expansion coefficient for each planetary rotor 424 and the pitch circle outer diameter of each planetary rotor 424 at the reference temperature.

As above, the valve timing adjusting device 400 according to the fifth embodiment provides effects similar to those of the valve timing adjusting device 10 according to the first embodiment and the valve timing adjusting device 200 according to the third embodiment. In addition, the linear expansion coefficient for the sun gear 423 is larger than the linear expansion coefficient for the planetary rotor 424. Inside the valve timing adjusting device 400, the linear expansion coefficient for the sun gear 423 as an external gear portion placed inward in the radial direction is larger than the linear expansion coefficient for each planetary rotor 424 as an external gear portion placed outward in the radial direction. The configuration enables to decrease a distance, which is to enable the sun gear 423 and each planetary rotor 424 to relatively move with an increase in temperature. The configuration enables to inhibit the momentum when a collision occurs between the sun gear 423 and each planetary rotor 424. The configuration enables to more efficiently inhibit the occurrence of a rattling sound when the valve timing adjusting device 400 is driven.

F. Other Embodiments

While there have been described embodiments of the present disclosure, the disclosure should not be understood exclusively in terms of the above-mentioned embodiments but may be applicable to various embodiments and combinations within the spirit and scope of the disclosure.

(1) According to the above-described first embodiment, linear expansion coefficients $\alpha b1$ and $\alpha b2$ of the internal gear portions 37 and 38 are set to the same value. However, linear expansion coefficients $\alpha b1$ and $\alpha b2$ may be set to values differing from each other. Namely, the driving internal gear portion 37 and the driven internal gear portion 38 may be formed of different steel materials. Similarly, linear expansion coefficients $\alpha a1$ and $\alpha ab$ of the external gear portions 50 and 51 are set to the same value. However, linear expansion coefficients $\alpha a1$ and $\alpha ab$ may be set to values differing from each other. Namely, the driving external gear portion 50 and the driven external gear portion 51 may be formed of different steel materials. In these cases, the driving side and the driven side each only require that linear expansion coefficients $\alpha a1$ and $\alpha a2$ of the external gear portion 50 and 51 are each larger than linear expansion coefficients $\alpha b1$ and $\alpha b2$ of the internal gear portion 37.

(2) According to the above-described first embodiment, limit diameter difference $\Delta Dy2$ for the driven side may not be smaller than limit diameter difference $\Delta Dy1$ for the driving side. For example, a configuration is supposed which sets limit diameter differences $\Delta Dy1$ and $\Delta Dy2$ to the same value. According to this configuration, when the driving internal gear portion 37, the driven internal gear portion 38, the driving external gear portion 50, and the driven external gear portion 51 reach limit temperature Ty, a collision between the driven external gear portion 51 and the driven internal gear portion 38 is considered to occur inasmuch as a collision between the driving external gear portion 50 and the driving internal gear portion 37. A configuration is supposed which allows limit diameter difference $\Delta Dy1$ for the driving side to be smaller than limit diameter difference $\Delta Dy2$ for the driven side. According to this configuration, when the driving internal gear portion 37, the driven internal gear portion 38, the driving external gear portion 50, and the driven external gear portion 51 reach limit temperature Ty, a collision between the driving external gear portion 50 and the driving internal gear portion 37 is more likely to occur than a collision between the driven external gear portion 51 and the driven internal gear portion 38. When there is a need to inhibit a rattling sound resulting from a collision between the external gear portion 50 or 51 and the internal gear portion 37 or 38, the driving side, not the driven side, just needs to manage the thermal expansion for a pair of gear portions including the driving external gear portion 50 and the driving internal gear portion 37.

(3) According to the above-described first embodiment, one of the driving side and the driven side may not allow linear expansion coefficients $\alpha a1$ and $\alpha a2$ of the external gear portions 50 and 51 to be larger than linear expansion coefficients $\alpha b1$ and $\alpha b2$ of the internal gear portions 37 and 38. At the driving side, for example, linear expansion coefficient $\alpha a1$ for the driving external gear portion 50 and linear expansion coefficient $\alpha b1$ for the driving internal gear portion 37 may be set to the same value.

(4) According to the above-described second embodiment, linear expansion coefficient $\beta c$ for the circular member 119 and linear expansion coefficient $\beta d$ for the retainer 141 may need not be set to the same value. Linear expansion coefficients $\beta c$ and $\beta d$ may be set to different values. Namely, the circular member 119 and the retainer 141 may be formed of different steel materials. Linear expansion coefficient $\beta a$ for the roller 134 and linear expansion coefficient $\beta b$ for the first ball bearing 133 may not be set to the same value. The roller 134 and the outer ring 133*b* of the first ball bearing 133 may be formed of different steel materials. In these cases, linear expansion coefficient $\beta b$ for the first ball bearing 133 just needs to be larger than linear expansion coefficient $\beta c$ for the circular member 119. Linear expansion coefficient $\beta a$ for the roller 134 may be larger than linear expansion coefficient $\beta d$ for the retainer 141.

(5) In the above-described third, fourth, and fifth embodiments, the planetary gear mechanism may be replaced by a roller deceleration mechanism such as the valve timing adjusting device 100 according to the second embodiment. Namely, the gear portion including the internal gear portion and the external gear portion may be replaced by the roller mechanism including the circular member, the inner rotor, the plurality of rollers, and the retainer. Generally, the deceleration mechanism changes relative rotational phases between the driving rotor and the driven rotor. The deceleration mechanism may be provided with at least one pair of roller mechanisms including a circular member, an inner rotor, a plurality of rollers, and a retainer. The circular member includes an internal tooth formed inward in a radial direction. The inner rotor is placed toward the inside of the circular member in a radial direction. The plurality of rollers are placed between the circular member and the inner rotor. The retainer retains the plurality of rollers between the circular member and the inner rotor. This configuration can provide effects similar to those of the above-described third, fourth, and fifth embodiments.

(6) In the third and fourth embodiments, the joint portions 253 and 353 are configured as the Oldham mechanism but are not limited thereto. A loosely inserted engaging mechanism including other unspecified universal joints, pins, and holes may configure any part of the eccentricity absorbing portions 225 and 325 so as to be able to transmit the power between the rotational shaft center AX3 and the eccentric shaft center AX4. This configuration can also provide effects similar to those of the above-described third and fourth embodiments.

(7) According to the fifth embodiment, the linear expansion coefficient for each planetary rotor 424 is larger than the linear expansion coefficient for the driving internal gear portion provided for the driving rotor 421 and the linear expansion coefficient for the driven internal gear portion provided for the driven rotor 422. However, the present invention is not limited thereto. The linear expansion coefficient for each planetary rotor 424 may be configured to be larger than at least one of the linear expansion coefficient for the driven internal gear portion provided for the driving rotor 421 and the linear expansion coefficient for the driven internal gear portion provided for the driven rotor 422. Similarly, with the increase in the temperature, the increase rate for the pitch circle outer diameter of each planetary rotor 424 may be configured to be larger than at least one of the increase rate for the pitch circle inner diameter of the driving internal gear portion provided for the driving rotor 421 and the increase rate for the pitch circle inner diameter of the driven internal gear portion provided for the driven rotor 422. A product between the linear expansion coefficient for each planetary rotor 424 and the pitch circle outer diameter of each planetary rotor 424 at a predetermined reference temperature may be configured to be larger than at least one of a product between the linear expansion coefficient for the driving internal gear portion provided for the driving rotor 421 and the pitch circle inner diameter of the driving internal gear portion provided for the driving rotor 421 at the reference temperature and a product between the linear expansion coefficient for the driven internal gear portion provided for the driven rotor 422 and the pitch circle inner diameter for the driven internal gear portion provided for the driven rotor 422 at the reference temperature. According to the fifth embodiment, the linear expansion coefficient for the sun gear 423 is larger than the linear expansion coefficient for each planetary rotor 424. However, the linear expansion coefficient for the sun gear 423 may be equal to or smaller than the linear expansion coefficient for each planetary rotor 424. Similarly, with the increase in the temperature, an increase rate for the pitch circle outer diameter of the sun gear 423 may be equal to or smaller than an increase rate for the pitch circle outer diameter of each planetary rotor 424. A product between the linear expansion coefficient for the sun gear 423 and the pitch circle outer diameter of the sun gear 423 at a predetermined reference temperature may be equal to or smaller than a product between the linear expansion coefficient for each planetary rotor 424 and the pitch circle outer diameter of each planetary rotor 424 at the reference temperature. This configuration can also provide effects similar to those of the above-described first, third, and fifth embodiments.

(8) According to the above-described embodiments, the valve timing adjusting devices 10, 100, 200, 300, and 400 may adjust the valve timing of the exhaust valve opened and closed by the camshaft instead of the valve timing of the intake valve opened and closed by the camshaft.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A valve timing adjusting device configured to adjust valve timing of a valve, which is configured to be opened and closed by a camshaft on application of engine torque transmitted from a crankshaft in an internal combustion engine, the valve timing adjusting device comprising:

a driving rotor configured to rotate about a rotational shaft center in conjunction with the crankshaft;

a driven rotor configured to rotate about the rotational shaft center in conjunction with the camshaft; and a deceleration mechanism configured to change a relative rotational phase between the driving rotor and the driven rotor by using a driving force of an electric motor, wherein the deceleration mechanism includes at least one pair of gear portions including:

an internal gear portion having an internal tooth extending radially inward; and an external gear portion having an external tooth extending radially outward and engaging with the internal tooth, wherein a linear expansion coefficient of the external gear portion is greater than a linear expansion coefficient of the internal gear portion.

2. The valve timing adjusting device according to claim 1, wherein the internal gear portion is provided on one of the driving rotor and the driven rotor and is configured to rotate about the rotational shaft center, wherein the external gear portion is configured to revolve about the rotational shaft center and to concurrently rotate about an eccentric shaft center parallel to the rotational shaft center, and the deceleration mechanism further includes a joint portion configured to transmit power between the rotational shaft center and the eccentric shaft center.

3. The valve timing adjusting device according to claim 2, wherein the internal gear portion is provided on the driven rotor, and the joint portion couples the external gear portion with the driving rotor.

4. The valve timing adjusting device according to claim 2, wherein the internal gear portion is provided on the driving rotor, and the joint portion couples the external gear portion with the driven rotor.

5. The valve timing adjusting device according to claim 1, wherein as temperature increases, an increase rate of a pitch circle diameter of the external gear portion is greater than an increase rate of a pitch circle diameter of the internal gear portion.

6. The valve timing adjusting device according to claim 1, wherein at a predetermined reference temperature, a product of the linear expansion coefficient of the external gear portion and a pitch circle diameter of the external gear portion is greater than a product of the linear expansion coefficient of the internal gear portion and a pitch circle diameter of the internal gear portion.

7. A valve timing adjusting device configured to adjust valve timing of a valve, which is configured to be opened and closed by a camshaft on application of engine torque transmitted from a crankshaft in an internal combustion engine, the valve timing adjusting device comprising:

a driving rotor configured to rotate about a rotational shaft center in conjunction with the crankshaft;

a driven rotor configured to rotate about the rotational shaft center in conjunction with the camshaft; and a deceleration mechanism configured to change a relative rotational phase between the driving rotor and the driven rotor by using a driving force of an electric motor, wherein the deceleration mechanism includes at least one pair of roller mechanisms including:

a circular member having an internal tooth extending radially inward;

an inner rotor placed concentrically inside the circular member;

a plurality of rollers placed between the circular member and the inner rotor; and a retainer configured to retain the rollers between the circular member and the inner rotor, wherein a linear expansion coefficient of the inner rotor is greater than a linear expansion coefficient of the circular member.

8. The valve timing adjusting device according to claim 7, wherein the circular member is provided on one of the driving rotor and the driven rotor and is configured to rotate about the rotational shaft center, the inner rotor is configured to revolve about the rotational shaft center and to concurrently rotate about an eccentric shaft center parallel to the rotational shaft center, and the deceleration mechanism further includes a joint portion configured to transmit power between the rotational shaft center and the eccentric shaft center.

9. The valve timing adjusting device according to claim 8, wherein the circular member is provided on the driven rotor, and the joint portion couples the inner rotor with the driving rotor.

10. The valve timing adjusting device according to claim 8, wherein the circular member is provided on the driving rotor, and the joint portion couples the inner rotor with the driven rotor.

11. The valve timing adjusting device according to claim 7, wherein as temperature increases, an increase rate of an outside diameter of the inner rotor is greater than an increase rate of a pitch circle diameter of the circular member.

12. The valve timing adjusting device according to claim 7, wherein as temperature increases, an increase rate of an outside diameter of each roller is greater than an increase rate of a difference between a pitch circle diameter of the circular member and an outside diameter of the inner rotor.

13. The valve timing adjusting device according to claim 7, wherein, at a predetermined reference temperature, a product of the linear expansion coefficient of the circular member and a pitch circle diameter of the circular member is less than a sum of:

a product of a linear expansion coefficient for each roller and an outside diameter of each roller and a product of the linear expansion coefficient of the inner rotor and an outside diameter of the inner rotor.

* * * * *